US006820691B2

(12) United States Patent
Follini et al.

(10) Patent No.: US 6,820,691 B2
(45) Date of Patent: Nov. 23, 2004

(54) CEMENTING TOOL AND METHOD

(75) Inventors: Jean-Marc Follini, Houston, TX (US); Arne Gaastra, Houston, TX (US); Herve Ohmer, Houston, TX (US)

(73) Assignee: Schlumberger Technology Corporation, Sugarland, TX (US)

( * ) Notice: Subject to any disclaimer, the term of this patent is extended or adjusted under 35 U.S.C. 154(b) by 142 days.

(21) Appl. No.: 10/054,555

(22) Filed: Jan. 22, 2002

(65) Prior Publication Data

US 2002/0088619 A1 Jul. 11, 2002

Related U.S. Application Data

(63) Continuation-in-part of application No. 09/518,365, filed on Mar. 3, 2000, now Pat. No. 6,349,769, which is a continuation-in-part of application No. 08/798,591, filed on Feb. 11, 1997, now Pat. No. 5,944,107, which is a continuation of application No. 08/898,700, filed on Jul. 24, 1997, now Pat. No. 6,056,059.

(60) Provisional application No. 60/263,935, filed on Jan. 24, 2001, provisional application No. 60/013,227, filed on Mar. 11, 1996, provisional application No. 60/022,781, filed on Jul. 30, 1996, and provisional application No. 60/025,033, filed on Aug. 27, 1996.

(51) Int. Cl.[7] ..... E21B 33/13

(52) U.S. Cl. ..... 166/291; 166/50; 166/177.4; 166/313

(58) Field of Search ..... 166/313, 50, 290, 166/291, 177.4

(56) References Cited

U.S. PATENT DOCUMENTS

| | | | | |
|---|---|---|---|---|
| 1,035,674 A | | 8/1912 | Baker | |
| 2,079,830 A | * | 5/1937 | Baker et al. | 166/142 |
| 2,114,521 A | * | 4/1938 | Brown | 166/291 |
| 2,925,865 A | | 2/1960 | Oliver | |
| 3,270,814 A | | 9/1966 | Richardson et al. | |
| 3,638,730 A | * | 2/1972 | Smith | 166/291 |
| 4,396,075 A | * | 8/1983 | Wood et al. | 175/79 |
| 4,415,205 A | * | 11/1983 | Rehm et al. | 299/5 |
| 4,450,912 A | | 5/1984 | Callihan et al. | |
| 4,573,541 A | * | 3/1986 | Josse et al. | 175/78 |
| 5,388,648 A | | 2/1995 | Jordan, Jr. | |
| 5,718,287 A | * | 2/1998 | Streich et al. | 166/66.6 |
| 5,806,614 A | * | 9/1998 | Nelson | 175/61 |
| 5,941,308 A | * | 8/1999 | Malone et al. | 166/313 |
| 5,944,107 A | | 8/1999 | Ohmer | |
| 6,056,059 A | | 5/2000 | Ohmer | |
| 6,079,495 A | | 6/2000 | Ohmer | |
| 6,170,571 B1 | | 1/2001 | Ohmer | |
| 6,283,216 B1 | | 9/2001 | Ohmer | |
| 6,302,203 B1 | * | 10/2001 | Rayssiguier et al. | 166/250.01 |
| 6,349,769 B1 | | 2/2002 | Ohmer | |

FOREIGN PATENT DOCUMENTS

| | | |
|---|---|---|
| GB | 2366816 | 3/2002 |

* cited by examiner

*Primary Examiner*—Hoang Dang
(74) *Attorney, Agent, or Firm*—Trop, Pruner & Hu, P.C.; Jeffrey E. Griffin; Brigitte Jeffery Echols

(57) ABSTRACT

An apparatus and method includes releasably engaging a cementing tool in a casing assembly at a junction of plural wellbores. Cementing slurry is pumped through the cementing tool to fill an annular region around the casing assembly. The cementing tool is retrievable without first milling components at the junction. The cementing tool has an anchoring mechanism adapted to engage a landing profile of the casing assembly. Further, the cementing tool has an external seal adapted to seal inside the casing assembly.

38 Claims, 18 Drawing Sheets

CEMENTING TOOL AND METHOD

CROSS REFERENCE TO RELATED APPLICATIONS

This claims the benefit under 35 U.S.C. §119(e) of U.S. Provisional Application Ser. No. 60/263,935, entitled "Cementing Tool," filed Jan. 24, 2001. This is also a continuation-in-part of U.S. Ser. No. 09/518,365, filed Mar. 3, 2000 now U.S. Pat No. 6,349,769, which is a continuation of Ser. No. 08/898,700 filed Jul. 24, 1997 now U.S. Pat. No. 6,056,059, which is a continuation-in-part of Ser. No. 08/798,591 filed Feb. 11, 1997 now U.S. Pat. No. 5,944,107, which claims priority under 35 U.S.C. §119(e) to U.S. Provisional Application Nos. 60/013,227, filed Mar. 11, 1996, 60/025,033, filed Aug. 27, 1996, and 60/022,781, filed Jul. 30, 1996, all hereby incorporated by reference.

TECHNICAL FIELD

The invention relates generally to cementing operations for wellbores. More specifically, the invention relates to a method and apparatus for cementing casing in a wellbore.

BACKGROUND

In the petroleum industry, wells are drilled in selected formations in an effort to produce hydrocarbons in commercially feasible quantities. During drilling operations for a typical oil or gas well, various earth formations are penetrated. To complete the well, casing is installed into the drilled wellbore.

Referring to FIG. 1, an example casing assembly 20 used in some oil and gas wells is shown. The casing assembly 20 for a given well is typically selected with an outer diameter that is small enough to go into the hole and still leave room for a cement layer 22 around the casing assembly 20, and an inner diameter that is large enough for the passage of downhole tools. Typically, as joints of the casing assembly 20 are connected to form a conventional casing string, the casing string is gradually moved downhole into the well. Once the desired length of a casing assembly 20 is connected, the casing assembly 20 is suspended or "hung" in the well, either from the surface or from the end of a previously cemented casing.

A casing assembly 20 may include a guide shoe (not shown) at the bottom of the casing assembly 20 to guide the casing assembly 20 as it is lowered into the well. A guide shoe prevents the casing assembly 20 from snagging on the wall of the wellbore 14 as it is lowered into the well. A fluid passage is typically formed through the center of the guide shoe to allow drilling fluid to flow up into the guide shoe as the casing assembly 20 is lowered into the wellbore 14. The fluid passage also allows cement pumped down the casing assembly 20 to flow downhole and out of the casing assembly 20 during cementing operations.

Cementing of the casing assembly 20 in the well is typically done by pumping a volume of cement into the casing assembly 20 sufficient to fill the annulus between the casing assembly 20 and the wellbore 14, followed by pumping displacement fluid on top of the cement to displace the cement down the casing assembly 20 and up the annulus between the casing assembly 20 and wellbore 14. The volume of cement required to fill the annulus between the casing assembly 20 and the wellbore 14 can be calculated from the geometry of the wellbore 14 and the geometry of the casing assembly 20 inserted in the wellbore 14.

Cementing techniques are well developed for single-bore wells. However, multilateral wells are becoming increasingly more desirable to improve production. A bore leading from the surface is referred to as a primary or main wellbore. Each of directional wellbores extending from the primary wellbore is referred to as a lateral wellbore. The junction between a primary wellbore and one or more lateral wellbores is referred to as a wellbore junction.

Casing and cementing in a multilateral well presents a greater challenge than for uni-bore wells, especially in providing support and pressure integrity at the wellbore junction between the primary wellbore and a lateral wellbore. Existing cementing technology for multilateral wells makes use of hardware components, such as cement retainers, packers, and diverters, which are permanently set in the casing assembly during cementing operations that must be milled to clear the path for subsequent drilling operations. At a wellbore junction, the milling of the hardware components and cement in the internal volume of the wellbore may cause damage at the wellbore junction. This milling operation can also be time consuming and costly because of the number of downhole trips required.

SUMMARY

In general, an improved cementing tool for cementing a casing assembly at a junction of plural wellbores is provided. For example, the cementing tool includes a body, an anchoring mechanism adapted to anchor the body within the casing assembly, and a flow conduit adapted to channel cement flow to an annular region outside the casing assembly. The anchoring mechanism is adapted to be released to enable retrieval of the cementing tool from the casing assembly.

Other or alternative features will be apparent from the following description, the drawings, and the claims.

DETAILED DESCRIPTION

In the following description, numerous details are set forth to provide an understanding of the present invention. However, it will be understood by those skilled in the art that the present invention may be practiced without these details and that numerous variations or modifications from the described embodiments may be possible.

As used here, the terms "up" and "down"; "upper" and "lower"; "upwardly" and downwardly"; "upstream" and "downstream"; "above" and "below"; and other like terms indicating relative positions above or below a given point or element are used in this description to more clearly describe some embodiments of the invention. However, when applied to equipment and methods for use in wells that are deviated or horizontal, such terms may refer to a left to right, right to left, or other relationship as appropriate.

Figure 1:
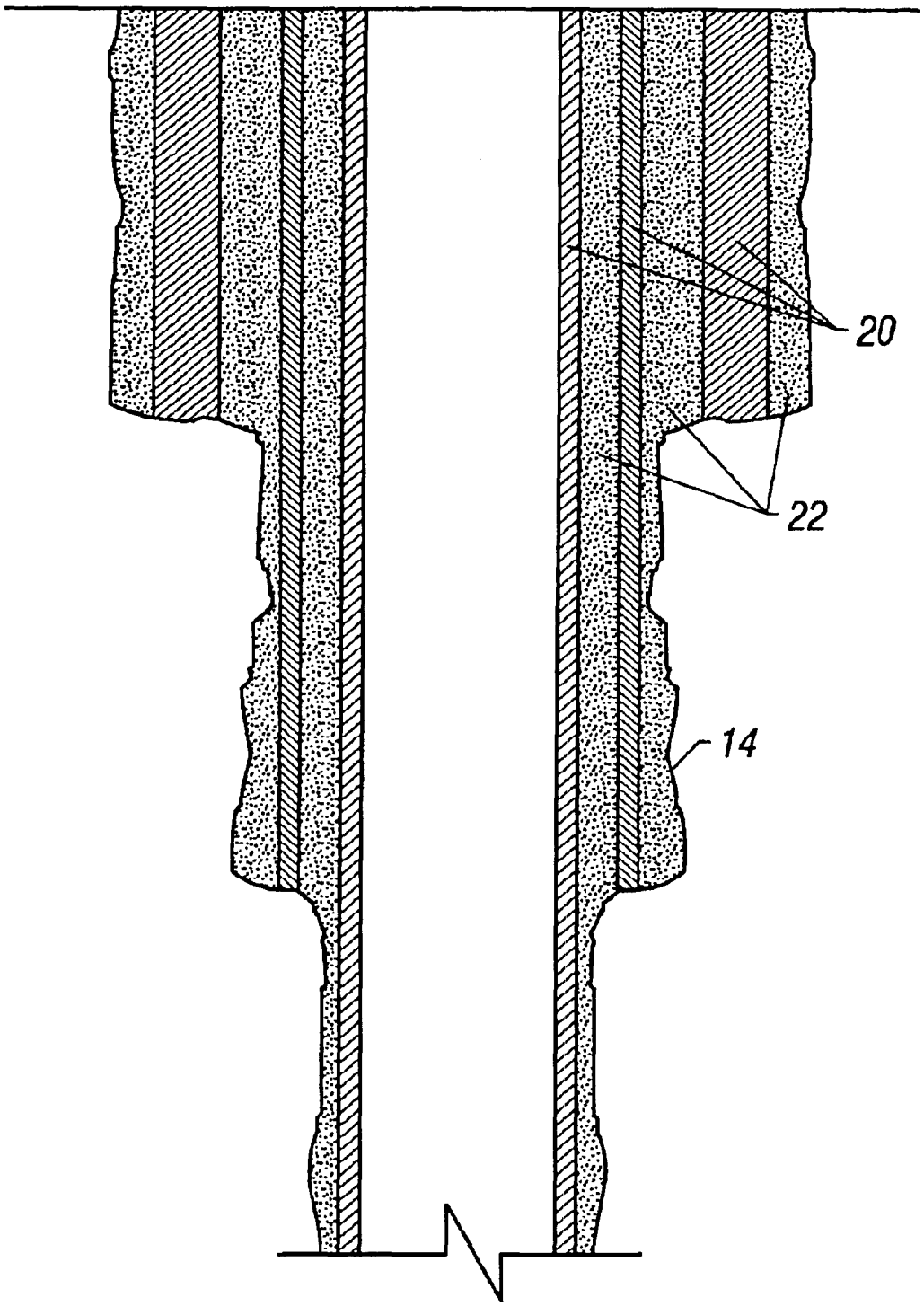
FIG. 1 (Prior Art)
FIG. 1 is a longitudinal sectional view of conventional casing cemented in a wellbore.
Figure 2:
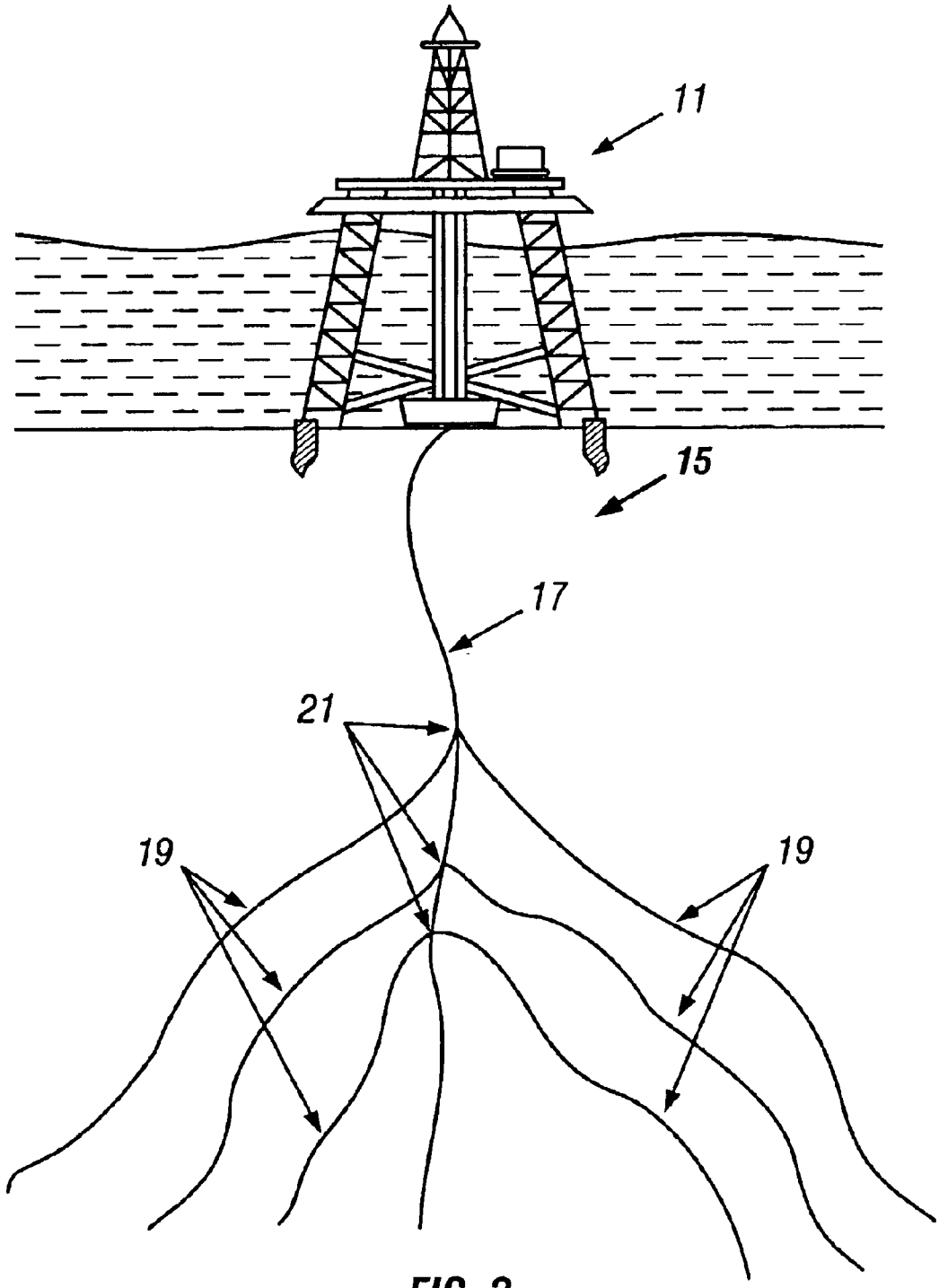
FIG. 2 illustrates a multilateral well in which a cementing tool according to some embodiments can be installed.

As shown in FIG. 2, a cementing tool according to some embodiments is positionable at various well junctions 21 in a multilateral well 15. In the example embodiment shown, a platform 11 is provided at the surface of the well 15, which is a subsea well. However, in other embodiments, the well 15 can be a land well.

The well 15 includes a primary wellbore 17 and several lateral wellbores 19. As used here, the term "wellbore" or "bore" can refer to either the primary wellbore or a lateral wellbore. The multilateral well 15 is completed with a casing assembly, including junction assemblies at respective well junctions 21. The cementing tool according to some embodiments is designed to cement the casing assembly at the well junctions 21. The term "casing" is intended to cover both casings and liners, or any other structure designed to line the wall of a wellbore.

Figure 3:
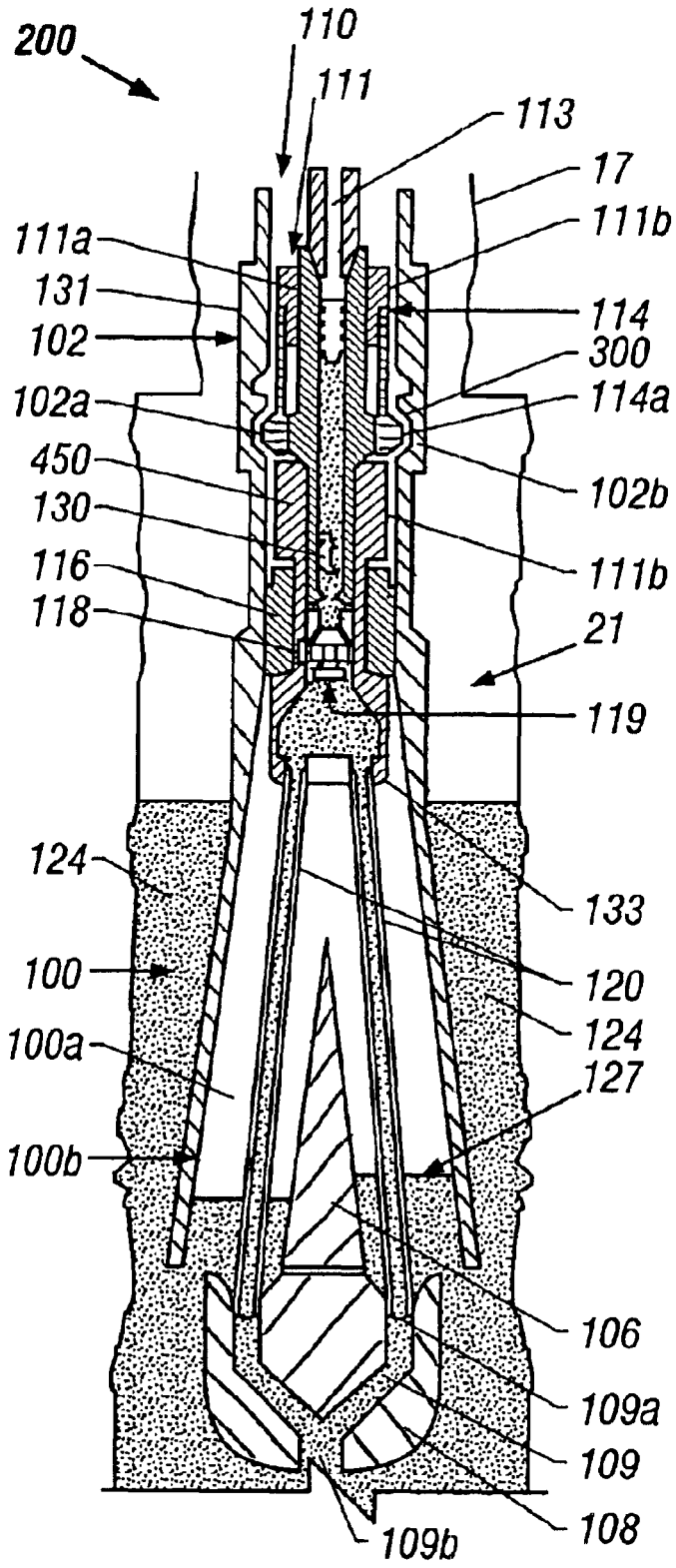
FIG. 3 illustrates one embodiment of the cementing tool used to cement a casing assembly at a lateral junction.
Figure 4:
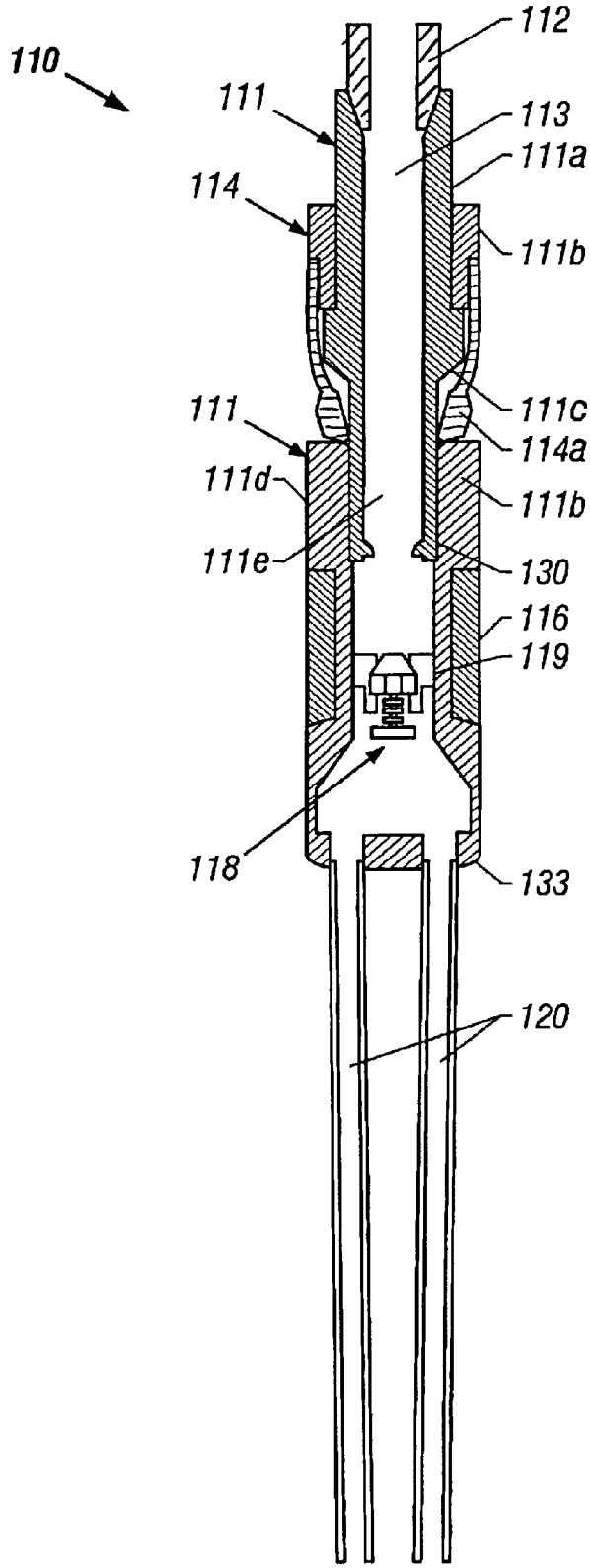
FIG. 4 is an isolated view of the cementing tool of FIG. 3.

FIG. 3 shows one embodiment of a cementing tool 110 being used to cement a casing assembly 200. The casing assembly 200 includes a casing junction assembly 100 that may be installed at each well junction 21 in the well 15. In the embodiment of FIG. 3, the cementing tool 110 is configured to be retrieved and to prevent the accumulation of cement in an internal volume 100*a* of the casing junction 100 so that the clean up required in the internal volume 100*a* of the junction 100 is minimized. An isolated view of the cementing tool 110 is shown in FIG. 4. An isolated view of the casing junction assembly 100 is shown in FIG. 5.

Figure 5:
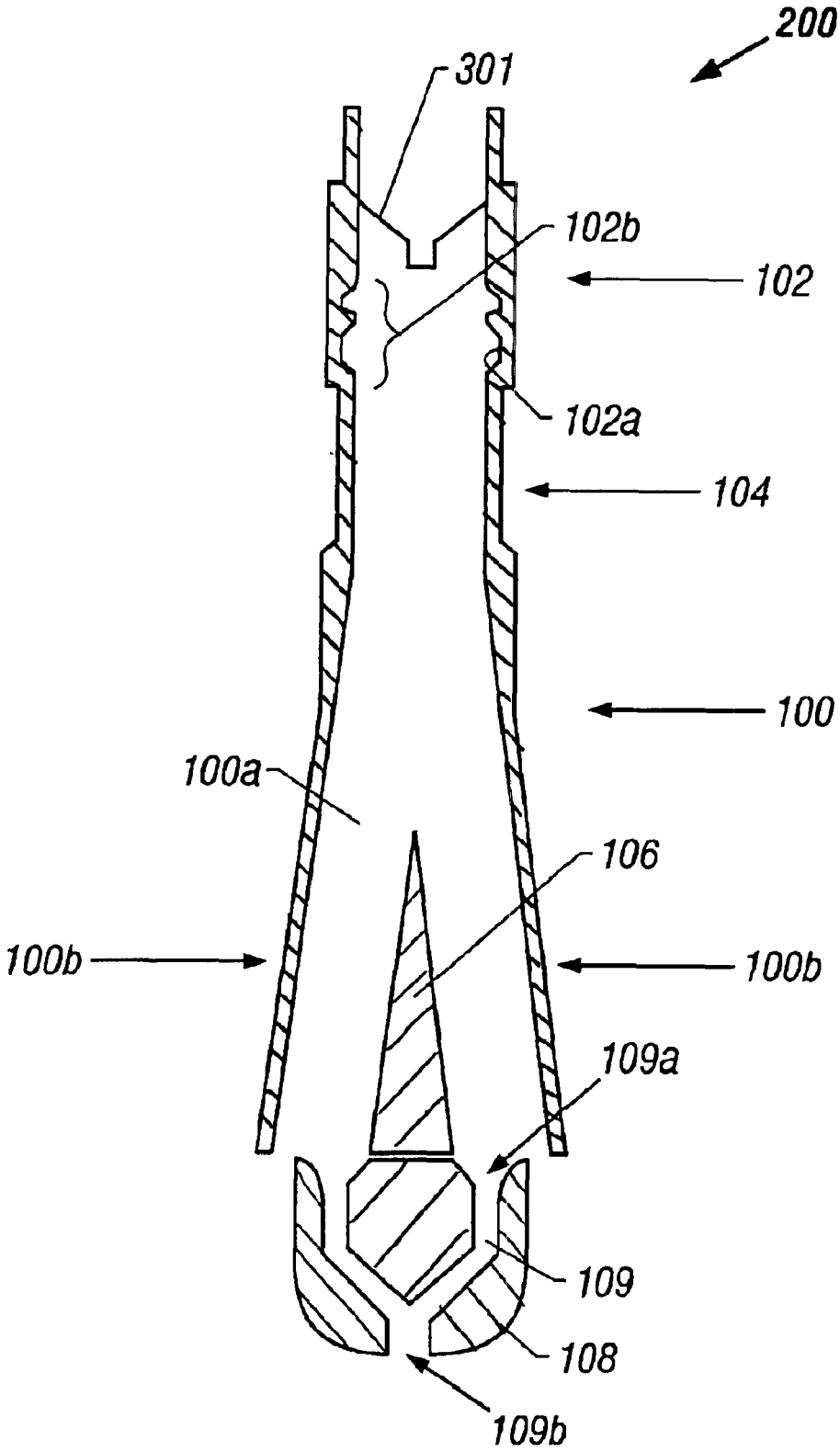
FIG. 5 is an isolated view of the casing assembly of FIG. 3.

Referring now to FIGS. 3 and 5, the casing assembly 200 includes the casing junction assembly 100 coupled to the end of a casing string (not shown) by a coupling section 102. The casing junction assembly 100 is used to provide support and pressure integrity for the lateral junction 21 defined between the primary wellbore 17 and one or more lateral wellbores 19 to be drilled. According to the guidelines established by the Technological Advancement of Multilaterals (TAML) consortium, this type of multilateral support structure may be classified as a Level 6 TAML Multilateral System. However, other types of casing junction assemblies can be used in other embodiments.

The casing junction assembly 100 illustrated in FIG. 5 is a deformable casing junction assembly 100, such as one disclosed in U.S. Pat. No. 5,944,107, which is hereby incorporated by reference. To install the casing junction assembly 100 in a wellbore, the casing junction assembly 100 in its deformed position (not shown) is suspended into a wellbore which has been back-reamed to produce a lower wellbore section with a larger diameter than the wellbore section above it (as shown in FIG. 3). An expansion tool (not shown) is then run into the casing junction assembly 100 and used to expand the casing junction assembly 100 from its deformed position to its reformed (fully opened) position, shown in FIGS. 3 and 5. Once in its opened position, the junction assembly 100 may be cemented in the wellbore and the lateral wells drilled through branches 100*b* defined by the casing junction assembly 100.

In this example, the end of the casing assembly 200 includes a guide shoe 108 attached to the bottom of the multilateral casing junction assembly 100 to guide the casing assembly 200 as it descends into the wellbore. The guide shoe 108 includes a fluid channel 109 that allows fluid to pass through the guide shoe 108 and up the annular space between the casing 200 and the wellbore. The fluid channel 109 in the guide shoe 108 includes one or more fluid inlets 109*a* at the upper side of the guide shoe 108 and one or more fluid outlets 109*b* at the lower side of the guide shoe 108.

The coupling section 102 has an internal landing profile 102*b* and a casing joint 104. The coupling section 102 may also include an orienting profile 301, such as a "muleshoe," to orient the cementing tool 110. The casing joint 104 is positioned in the casing to provide a desired spacing between the junction assembly 100 and the landing profile 102*b*. The casing assembly 200 shown in FIG. 5 is only one example of a casing assembly for which a cementing tool may be configured for use in, as other types of casing assemblies can be used in other embodiments.

Figure 6:
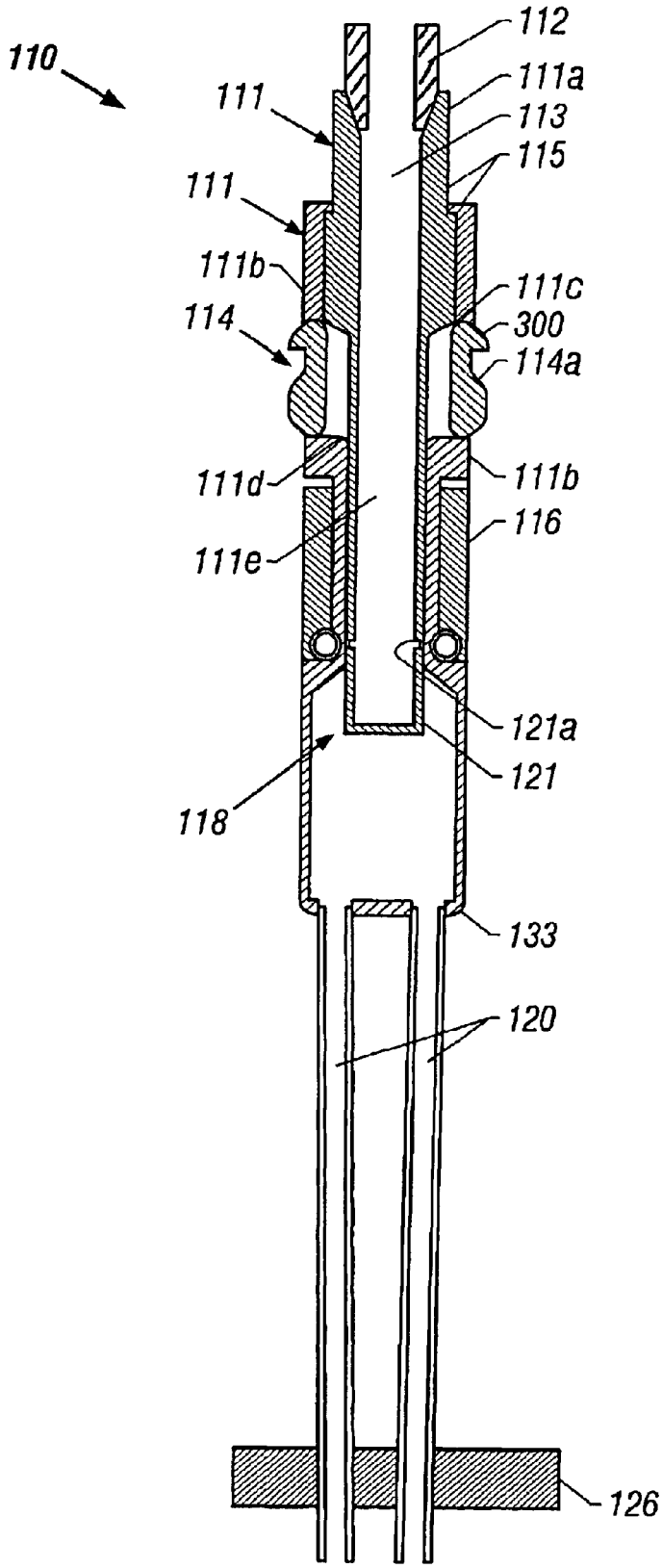
FIG. 6 is an isolated view of another embodiment of a cementing tool configured to cement the casing assembly of FIG. 5.
Figure 7:
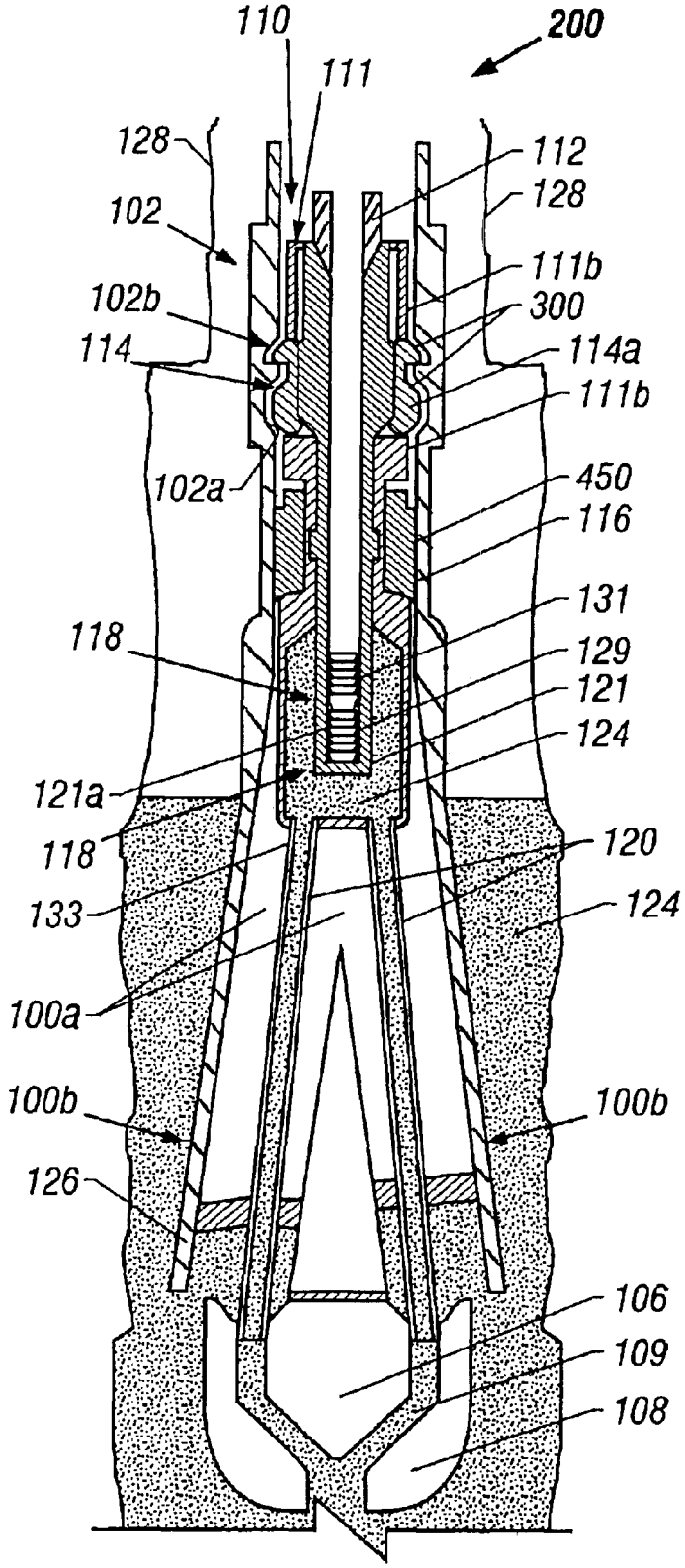
FIG. 7 illustrates the cementing tool of FIG. 6 being used to cement the casing assembly of FIG. 5.

FIGS. 3 and 4 show one embodiment of the cementing tool 110. FIGS. 6 and 7 show another embodiment of the cementing tool. Referring to FIGS. 3 and 4, the cementing tool 110 is adapted to attach to the end of a work string 112. The work string 112 includes a string of hollow pipe used to lower the cementing tool 110 into the casing assembly 200. The work string 112 may also be adapted to channel cement and displacement fluid pumped from the surface down to the cementing tool 110 when positioned in the wellbore.

The cementing tool 110 includes a generally cylindrical body 111. The body 111 includes a first member 111*a* slidably coupled with respect to a second member 111*b*. One end of the first member 111*a* is adapted to couple to the work string 112. The other end of the first member 111*a* operatively couples to the second member 111*b* and is adapted to slide axially to a limited extent with respect to the second member 111*b*. An internal bore 113 extends axially through the first member 111*a* and the second member 111*b* to permit fluid flow through the body 111 of the cementing tool 110.

Another embodiment of a cementing tool 110 configured for use in the casing assembly 200 of FIG. 5 is shown in FIG. 6. The body 111 of the cementing tool in this embodiment also includes a first member 111*a* and a second member 111*b* slidably coupled in a manner similar to the embodiment described above. However, in other embodiments, the body 111 may be configured differently than generally cylindrical and may include one member or a plurality of connected members with a fluid passage defined therein, without departing from the spirit of the invention.

Referring to FIGS. 3 and 7, the cementing tool 110 further includes at least one bypass device 120 for channeling cement from the body 111 of the cementing tool 110 to a desired location to prevent the accumulation of cement in an intermediate volume of the casing junction assembly 100. The distal end of each bypass device 120 is configured to seat in the fluid channel 109 of the guide shoe 108. In one embodiment, the bypass device 120 may form a seal with the fluid channel 109 of the guide shoe 108 to prevent cement exiting the bypass device 120 from flowing into the internal volume 100*a* of the casing junction 100. In the embodiments shown, the at least one bypass device 120 includes a plurality of bypass tubes (or another type of conduit) that extend from the second member 111*b* of the body 111 and are adapted to engage in fluid communication with a corresponding fluid channel 109 in the guide shoe 108.

In another embodiment of the invention, the cementing tool 110 does not include a bypass device 120, and the guide shoe 108 does not include the fluid channel 109. Instead, the second member 111*b* of the body 111 includes outlets enabling the flow of cement from the interior to the exterior of the cementing tool 110.

The cementing tool 110 further includes an anchoring mechanism 114 configured to anchor the cementing tool 110 into place within the casing assembly 200. In the embodiments shown, the anchoring mechanism 114 includes a plurality of keys 114*a* azimuthally disposed about the body of the cementing tool 110 and configured to engage into a landing profile 102*b* in the casing assembly 200. In the embodiment shown in FIG. 3, the anchoring keys 114*a* are radially extendable, attached to the second member 111*b*, and slidably coupled about an outer surface of the first member 111*a* of the body 111.

FIG. 3 shows the anchoring keys 114*a* in the activated (or expanded) position, and FIG. 4 shows the anchoring keys 114*a* in a deactivated (or retracted) position. In another embodiment, the anchoring mechanism may include a single key, such as a retractable ring-shaped key radially disposed about the body of the cementing tool.

As shown in FIG. 3, the anchoring mechanism 114 is configured to engage in the landing profile 102*b* provided in the coupling section 102 located above the casing junction assembly 100. The anchoring keys 114*a* are radially biased outwardly to engage in the annular recess 102*a* of the landing profile 102*b* as the cementing tool 110 descends into position in the casing junction assembly 100. Alternatively, the anchoring keys 114*a* may be spring loaded to automatically extend outwardly when brought into axial alignment with the landing profile 102*b*, as in the embodiment of FIG. 7.

Once the anchoring keys 114*a* land in the landing profile 102*b*, the lower body 111*b* and the at least one bypass device 120 will be restricted from further axial movement in the casing assembly 200. Subsequent increase of the axial force on the cementing tool 110 results in the axial downward movement of the first member 111*a* with respect to the second member 111*b* and the anchoring mechanism 114. With downward movement of the first member 111*a*, an enlarged portion 111*c* of the first member 111*a* slides down to engage and lock the keys 114*a* in the landing profile 102*b*.

In one embodiment, the keys 114*a* are configured to withstand axial forces, which may be exerted on the cementing tool 110, such as forces due to the weight of the tool 110 and work string 112 or buoyancy forces exerted by the cement 124 on the tool 110 during the cementing operation. Those skilled in the art will appreciate that the invention is not limited to an anchoring mechanism 114 with keys 114*a* as described above. Rather, any type of anchoring mechanism suitable for downhole tools may be used in other embodiments without departing from the spirit of the invention.

The cementing tool 110 may also include at least one orienting key (not shown) attached to the body 111. In one embodiment, the orienting key may be one of the anchoring keys 114*a* that is specially adapted and located to mate with orienting profile 301 in the casing assembly 200. The orienting key cooperates with the orienting profile 301 of the coupling section 102 to orient the cementing tool 110 so that each bypass device 120 lands in an inlet 109*a* of the fluid channel 109 of the guide shoe 108. It is noted that the orienting key and orienting profile 301 are not required in those embodiments of cementing tool 110 that do not include a bypass device 120.

As shown in FIGS. 4 and 6, the body 111 of the cementing tool 110 also includes at least one shear pin 111*e* connecting the first member 111*a* and the second member 111*b* of the body 111 to prevent axial movement of the first member 111*a* with respect to the second member 111*b* until a sufficient shearing force is applied on the pin 111*e*. Once the cementing tool 110 lands and is anchored into the casing assembly 200, as shown in FIGS. 3 and 7, the shear pin 111*e* connecting the first member 111*a* to the second member 111*b* may be sheared by applying an increased downward force on the tool 110. Once the pin 111*e* is sheared, the first member 111*a* is permitted to move axially with respect to the second member 111*b* to lock the anchoring keys 114*a* of the tool 110 into the landing profile 102*b* of the casing assembly 200.

Figure 9A:
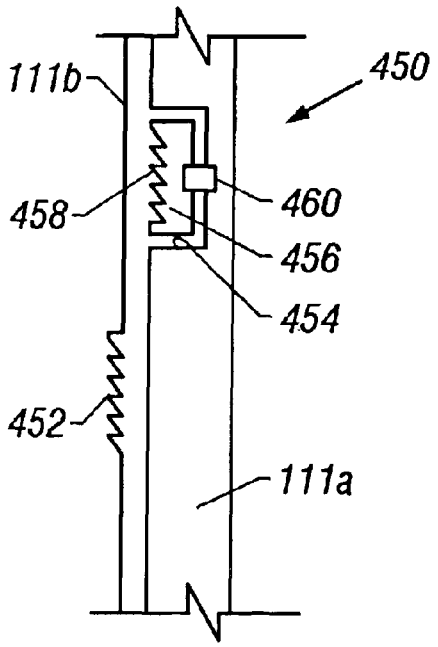
FIGS. 9A–B are sectional views of one example of a securing mechanism used in the cementing tool of FIG. 4 or 6.
Figure 9B:
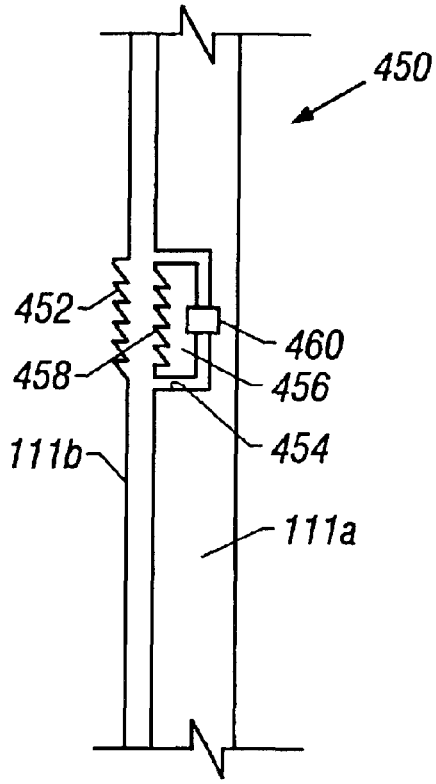

Once the first member 111*a* of body 111 has concluded its sliding motion, a securing mechanism, such as a ratchet mechanism 450 (see FIGS. 3, 7, 9), is activated to secure the first member 111*a* to the second member 111*b* of the body 11. FIGS. 3 and 7 show the general location of the ratchet mechanism 450, while FIGS. 9A–B shows the ratchet mechanism 450 in more detail. FIG. 9A shows the ratchet mechanism 450 prior to the sliding motion of first body member 111*a*. FIG. 9B shows the ratchet mechanism 450 subsequent to the sliding motion of first body member 111*a*. The ratchet mechanism 450 comprises teeth 452 on second body member 111*b* that mate with teeth 458 on first body member 111*a* when the first body member 111*a* has concluded its sliding motion (as shown in FIG. 9B). Prior to this, the first body member teeth 458 are located above the second body member teeth 452. When mated, the teeth 452, 458 are configured to prevent upward movement but allow downward movement of first body member 111*a* relative to the second body member 111*b*. First body member teeth 458 are, in one embodiment, located on a ratchet key 456 that is attached by a shear pin 460 within a recess 454 of first body member 111*a*. In another embodiment (not shown), it is the second body member teeth 452 that are located on a similar ratchet key attached by a shear pin within a recess of second body member 111*b*.

The cementing tool 110 further includes at least one sealing element 116 disposed about the exterior of the cementing tool 110 to affect a fluid seal between the cementing tool 110 and the casing assembly 200. Once the cementing tool 110 is in position in the multilateral casing junction assembly 100, the sealing element 116 may be hydraulically set to seal the volume in the annulus between the work string 112 and the casing string above the sealing element 116 from the volume in the annulus between the multilateral casing junction assembly 100 and the cementing tool 110 below the sealing element 116. The sealing element 116 may be disposed within a recess in the exterior surface of the second member 111*b* of the body 111. Those skilled in the art will appreciate that the invention is not limited to using a sealing element or the sealing element described above. Rather any sealing device, including hydraulically, electrically, and mechanically set sealing devices, may be used without departing from the spirit of the invention. Further, it should be understood that the sealing element 116 can be attached to some other component.

The cementing tool 110 may further include a flow control device 118 disposed within the body 111 of the cementing tool 110 to selectively permit the flow of cement through the cementing tool 110. In the embodiment shown in FIG. 3, the flow control device 118 is a check valve 119 that permits the downward flow of cement through the cementing tool 110 but prevents the upward flow of cement back up the cementing tool 110 and into the work string 112.

In the embodiment shown in FIGS. 6 and 7, a flow control device 118*a* according to another embodiment is a sliding sleeve 121 remotely controlled from the surface. The sliding sleeve 121 includes a cylindrical body having one or more orifices 121*a* through which fluid, such as cement slurry, may flow. The sliding sleeve 121 is integral with the first member 111*a* of the body 111 and thus moves with the first member 111*a* as it is moved from its upper position (FIG. 6), to its lower position (FIG. 7) with respect to the second member 111*b*. The orifice(s) 121*a* are positioned within the sliding sleeve 121 such that when the first member 111*a* is in its upper position (FIG. 6) the orifice(s) 121*a* are blocked by the second member 111*b* to prevent fluid flow through the orifice(s) 121*a*. However, when the first member 111*a* is in its lower position (FIG. 7), orifice(s) 121*a* are unobstructed to permit fluid to flow through them. In other embodiments, the flow control device 118 may include any other device that can be used to selectively permit flow through the cementing tool 110. Further, the location of the flow control device 118 can be varied.

To permit retrieval of the cementing tool 110 from the casing assembly 200 after the cementing operation, the anchoring mechanism 114 of the cementing tool 110 is configured to be set and released on demand from the surface. In one embodiment, the anchoring mechanism 114 may be released from the surface by pulling up on the first member 111*a* of the body 111. The pulling motion may be performed by the work string 112, which may be left downhole throughout the cementing operation, or by a retrieval tool (not shown) attached to the end of another (or the same) work string that is adapted to attach to the first member 111*a*. The resulting upward force on the first member 111*a* results in the shearing of the ratchet shear pins 460 (FIGS. 9A–9B) and thus the disablement of the ratchet mechanism 450. Once the ratchet mechanism 450 is disabled, the resulting upward movement of the first member 111*a* relative to the second member 111*b* results in the position shown in FIGS. 4 and 6, wherein the first member 111*a* no longer prohibits the inward motion of the keys 114*a* (the protruding portion 111*c* of the first member 111*a* is no longer wedged against the keys 114*a*). Continued upward movement eventually results in the first member 111*a* picking up on the second member 111*b* (at shoulder 115 of the first member 111*a*) and the second member 111*b* being pulled upwardly together with the first member 111*a*.

Continued upward movement causes the keys 114*a* to be released from (forced out of) the landing profile 102*b*. This release is facilitated by the angled portions 300 of the keys 114*a* and the landing profile 102*b* that interact with each other and due to the fact that the keys 114*a* are no longer locked in place by the first member 114*a* and are now free to retract radially inward. After the keys 114*a* are released from the annular recess 102*a*, the cementing tool 110 can be removed from the casing assembly 200 upon completion of the cementing operation, as further described below.

In the FIG. 7 embodiment, the cementing tool 110 may further include a barrier 126 disposed about a periphery of at least one bypass device 120 to prevent cement 124 from back filling into the internal volume 100*a* of the junction 100. In one embodiment, the barrier 126 includes a deformable rubber retainer. The barrier 126 may include an opening therein for receiving a bypass device 120. When the cementing tool 110 is inserted into the casing assembly 200, the barrier 126 may deform into a retracted position to fit down the primary borehole of the casing assembly 200 and then may expand in the casing junction assembly 100 between a bypass device 120 and the inside of the lateral branches 100*b* of the casing junction assembly 100. The barrier 126 may also be configured, such as with sloped edges capable of scaling the wall of the junction, to retract as the tool is moved up the casing junction assembly 100 and primary bore of the casing assembly 200 for removal after the cementing operation. Alternatively, the barrier 126 may be designed to break away from the portion of the tool 110 removed from the wellbore 128 and remain downhole after the cementing operation. In such case, the barrier 126 will have to be milled or drilled out before resuming drilling operations. In other embodiments, the barrier may include any device or material capable of preventing the back flow of cement into the junction 100 without departing from the spirit of the invention. In one embodiment, the barrier 126 prevents cement back flow without forming a pressure seal to allow for pressure equalization across the walls of the junction 100 during the cementing operation.

Alternatively, in the FIG. 3 embodiment, the cement is prevented from back filling into the internal volume 100*a* of the casing junction assembly 100 (at 127) by the drilling fluid trapped in the internal volume 100*a* of the casing junction 100. In this embodiment, drilling fluid in the internal volume 100*a* of the casing junction 100 prior to cementing is trapped in the internal volume 100*a* between the seals 116 of the cementing tool 110 and cement exiting the guide shoe 108 and flowing up the annulus between the casing assembly 200 and the wellbore 128.

To perform a cementing operation with the example tools shown, the cementing tool 110 is attached to the end of the work string 112, which is then lowered into a casing assembly 200 in the wellbore 128. In the embodiment including the bypass device 120, the orienting profile 301 of the coupling section 102 acts to orient the cementing tool 110 so that each bypass device 120 lands in an inlet 109*a* of the fluid channel 109 of the guide shoe 108. The at least one bypass device 120 at the lower end of the cementing tool 110 lands in the corresponding inlet 109*a* of the fluid channel 109 of the guide shoe 108. The bypass device 120 and the inlet 109*a* in the guide shoe 108 may be configured with sloped mating surfaces to guide the bypass device 120 into position in the guide shoe 108. Downward axial force on the cementing tool 110 may further force the mating surfaces of the bypass device 120 and guide shoe 108 together which may help them form a fluid seal.

As the bypass device 120 lands in the guide shoe 108, the anchoring mechanism 114 enters the landing profile 102*b* above the casing junction assembly 100. The keys 114*a* are biased to extend radially outwardly when brought into substantial axial alignment with the landing profile 102*b* to engage in the landing profile 102*b*. This anchors the cementing tool 110 in place. As a result, an increased downward axial force on the cementing tool 110 shears the shear pin (111*e* in FIGS. 4 and 6) between the first member 111*a* and the second member 111*b* of the body 111. The first member 111*a* then slides axially downwardly with respect to the second member 111*b* and anchoring mechanism 114 to lock the keys 114*a* into the landing profile 102*b* in the casing assembly 200. The first member 111*a* comes to rest against shoulder 111*d* of the second member 111*b* of the body 111 and further downward movement of the cementing tool 110 ceases. As the first member 111*a* concludes its sliding motion, the ratchet mechanism 450 engages (the teeth 452, 458 mate) thereby securing the first member 111*a* to the second member 111*b*.

At the surface, proper landing and locking of the cementing tool 110 into the casing assembly 200 may be determined based on the "hung weight" at the top of the work string 112 at the surface. Thus, the cementing tool 110, advantageously, can provide positive feedback on the positioning of the cementing tool 110 in the casing assembly 200 based on hung weight reductions corresponding to the landing of the anchoring mechanism 114, the shearing of the shear pin 111*e*, and the locking of the tool 110 into the casing assembly 200.

In another embodiment, instead of or in addition to the anchoring mechanism 114, the casing junction 100 includes a shoulder (not shown) in its interior. The cementing tool 110 sits on the shoulder, which shoulder absorbs all or a portion of the weight.

Once the cementing tool 110 is locked into place, the sealing element 116 is hydraulically set. Prior to pumping cement, the cementing tool 110 and work string 112 will be surrounded by drilling fluid or the like. Thus, prior to pumping cement down the work string 112, the internal volume 100*a* of the casing junction 100 will be filled with drilling fluid.

Cement is then pumped down the work string 112 to the cementing tool 110. A fluid separator, such as a rubber plug (129 in FIG. 7), may precede the flow of cement in the work string 112 to separate the cement from drilling fluid in the work string 112 and the cementing tool 110 prior to the pumping of cement. Cement is then pumped on top of the plug 129 to displace drilling fluid down the work string 112 and out of the cementing tool 110. The plug 129 eventually comes to rest proximal the flow control device 118 in the body 111 of the cementing tool 110.

In the embodiment of FIG. 3, the rubber plug (not shown), if used, may seat above the check valve 119 at the internal lip shown at 130. The plug may include a membrane that ruptures due to continued pumping of the cement on top of the plug once it seats to cause a membrane in the plug to rupture, opening a passage in the plug that permits the flow of cement through the cementing tool 110 and into the guide shoe 108.

In the embodiment of FIG. 7, rubber plug 129 seats in the sleeve 121 below the orifice(s) 121*a* such that the flow of cement behind the plug is permitted to exit the sleeve 121 of the tool and flow through the at least one bypass device 120 to the guide shoe 108.

In the embodiments including the bypass device 120, the connection between the at least one bypass device 120 and guide shoe 108 and fluid trapped in the internal volume 100*a* of the casing junction 100 may prevent the cement from back flowing into the internal volume 100*a* of the multilateral casing junction assembly 100. However, as noted above the barrier 126 in FIG. 7 may be provided on the tool 110 to extend between the bypass device 120 and the corresponding branch 100*b* of the casing junction assembly 100 to prevent the back flow of cement 124 into the internal volume 100*a* of the junction assembly 100, while permitting pressure equalization across the walls of the junction assembly 100.

At the surface, once the predetermined amount of cement has been pumped down the work string 112, displacement fluid is pumped down the work string 112 to force the last of the cement down the work string 112 and out of the cementing tool 110. A second fluid separator, or rubber plug 131 (in FIG. 7), may be placed in the work string 112 to separate the cement from the displacement fluid as the displacement fluid is pumped down the work string 112.

As illustrated in FIG. 7, the pumping of displacement fluid continues until the second rubber plug 131 displaces the last of the cement through the body of the cementing tool 110. The second rubber plug 131 comes to rest against the first plug 129 seated in the cementing tool 110 and prevents further flow of displacement fluid through the cementing tool 110.

In the embodiment of FIG. 3, the second plug 131 may seat in the first plug (described above) to block the fluid passage in the first plug. In the embodiment of FIG. 7, the second plug 131 seats on the first plug 129, as shown, and blocks the orifice(s) 121*a* in the sliding sleeve 121. The seating of the second plug 131 in the cementing tool 110 is indicated at the surface by a pressure increase, at which time pumping of displacement fluid ceases.

In the embodiment including the bypass device 120, the cement pumped through the cementing tool 110 passes through the at least one bypass device 120, into the fluid channel 109, and out of the fluid channel 109 through outlet 109*b*. Once out of the outlet 109*b*, the cement is forced upward to the annular area between the casing junction assembly 100 and the wellbore to cement the casing assembly 200 in place. The displacement fluid pumped on top of the second plug 131 ensures that the necessary volume of cement is forced into such annular area. As the displacement fluid is pumped, the cement is forced upwardly in the annular area. The cement will typically surround at least the entire casing junction assembly 100, but may also surround a substantial portion of the remainder of the casing assembly 200.

In the embodiment not including the bypass device 120, cement flows through the bottom (outlets) of the cementing tool 110 and through the outlets of the casing junction assembly 100. The cement is then forced upward to the annular area between the casing assembly 200/casing junction assembly 100 and the wellbore to form the cement layer 124.

Once the cement pumping phase is complete, the cementing tool 110 (in part or in whole) will remain in place until the cement 124 in the wellbore has hardened. The work string 112 may be detached from the cementing tool 110 and returned to the surface during this time. Once the cement has cured, the anchoring mechanism 114, being isolated from the cement operation, may be unlocked and disengaged from the casing so that the cementing tool 110 can be retrieved from the wellbore 128.

Depending on the type of anchoring mechanism used, retrieval of the cementing tool 110 from the wellbore may require a retrieving tool to unlock the anchoring mechanism 114 from the landing profile 102*b* of the casing assembly 200. However, in the embodiments shown in FIGS. 3 and 7, the cementing tools are configured such the work string 112 attached to the first member 111*a* of the cementing tool 110 may be used to provide a sufficient upward axial force to pull the first member 111*a* into its upward position to disengage the ratchet mechanism 450 (by shearing the shear pins 460) and unlock the anchoring mechanism 114 from the landing profile 102*b*. Once unlocked, an additional upward force can be applied to the tool 110 to force the anchoring keys 114*a* to retract as they are forced up the landing profile 102*b*. In an alternative embodiment, the anchoring keys 114*a* may be, at this point, biased radially inward, in which case the keys 114*a* will automatically disengage once unlocked from the landing profile 102*b*. Other devices and techniques for locking and retrieving downhole tools may be used in other embodiments.

In one embodiment, once the cementing tool 110 is unlocked from the casing assembly 200, the only connection retaining the cementing tool 110 in the wellbore 128 is the column of hardened cement 124 in the at least one bypass device 120 leading into the guide shoe 108. The connection between the cementing tool 110 and the guide shoe 108 may be severed simply by applying a rotational torque and/or an upward axial force to the cementing tool 110 to break the cement column between the at least one bypass device 120 and the guide shoe 108. In this manner, the cementing tool 110 in its entirety is retrieved, including the bypass device 120 as a whole. In such case, no clean up or drill-out in the internal volume 100*a* of the junction 100 is typically required. This, advantageously, allows normal drilling operations to be resumed quickly and safely down the selected lateral branch 100*b* of the junction assembly 100 without harm to the mechanical integrity of the junction assembly 100.

In other embodiments, once the cementing tool 110 is unlocked from the casing assembly 200, a simple upward force on the cementing tool 110 is not sufficient to break the connection between the cementing tool 110 and the cement 124. In some applications, this connection may be broken by providing at least one bypass device 120 of the cementing tool 110 that is frangible such that in response to a sufficient upward force, the connection between the at least one bypass device 120 and the second member 111*b* of the body 111 is broken. This results in the at least one bypass device 120 being left in the casing junction 100 and the body 111 and other portions of the cementing tool 110 being released from the wellbore 128 and pulled to the surface.

Figure 8:
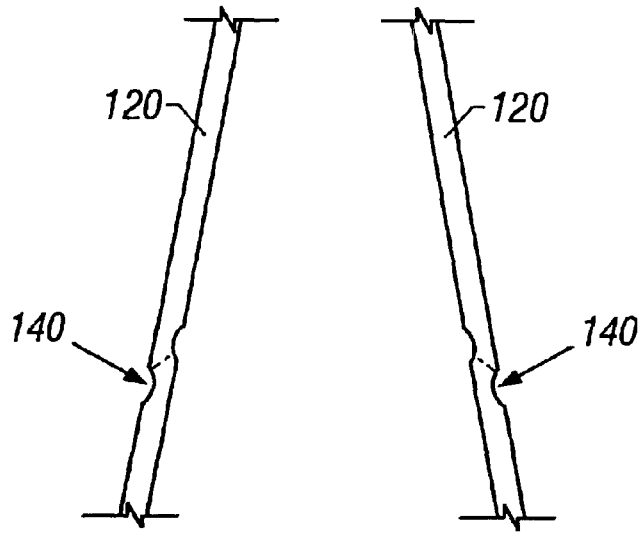
FIG. 8 illustrates one example of bypass tubes useable with the cementing tool of FIG. 4 or 6, the bypass tubes configured to break at selected locations.

Alternatively, the cementing tool 110 may be designed to have one or more selected weak points, such that a sufficient upward force or torque on the tool will result in the breaking off of a portion of the tool 100 below the weak point. For example, the at least one bypass device 120 may be bypass tubes configured to have a weak point, such as a narrowed section or neck (140 in FIG. 8), configured to break in response to a sufficient upward or twisting force applied to the cementing tool 110. Thus, if cement is allowed to backfill to a limited degree into the casing assembly 200 around the end of the bypass device 120, as shown in FIG. 3, rotation of or an upward force on the cementing tool 110 may result in the shearing of the at least one bypass device 120 at or above the portion of the bypass device 120 embedded in the cement 124.

Alternatively, the lower part of the body 111 may include a subsection designed to break off, such as at 133 in FIG. 3 where the at least one bypass device 120 inserts into the body. The location of the weak point or breakaway point may be located at various points along each bypass device 120. However, in some embodiments, a substantial portion of the cementing tool 110 is retrievable from the wellbore 128 so that milling or drill out operations originate in the branches 100*b* of the junction 100 rather than above the junction divider 106 to minimize the likelihood of damage to the junction 100 during milling.

If a portion of the at least one bypass device 120 is left in place in the cement 124, then that portion, along with the cement 124 and a portion of the guide shoe 108 below the internal volume 110*a* of the junction 100 will need to be milled before the lateral wells can be drilled. Therefore, the at least one bypass device 120 and the guide shoe 108 may be formed of a material that is easily milled, such as a plastic, rubber, thin-walled aluminum, or other frangible or drillable material, so that milling can be easily done without producing large resultant forces on the milling tool that could cause the mill to forcibly knock against and damage the divider 106 and branches 100*a* of the casing junction 100.

FIGS. 10A–10J are schematic diagrams of a different embodiment of a cementing tool 500 adapted to be installed in the casing assembly 200. A longitudinal sectional view of the cementing tool 500 is shown in FIGS. 11A–11D. FIGS. 12A–12D are a side view of the cementing tool corresponding to the view of FIGS. 11A–11D. Reference is made to FIGS. 10A–10J, 11A–11D, and 12A–12D in the following description. The cementing tool 500 includes locking keys 502 for engagement in landing profiles 102*b* of the casing assembly. Upper ends of the locking keys 502 are engaged by leaf springs 506 (FIG. 11B) to an upper housing 504 of the cementing tool 500, while the lower ends of the locking keys 502 are engaged by leaf springs 506 to another body portion 520.

The cementing tool 500 also includes a retrieving mandrel 508 that has a retrieving profile 510 to which a retrieving tool can be engaged to lift the cementing tool 500 for retrieval from the well. The cementing tool 500 also includes a control mandrel 512. A lower end of the control mandrel 512 is attached to a sleeve 514 by a shearing mechanism 516 (see FIG. 11A). In one embodiment, the shearing mechanism 516 includes one or more shear screws.

Figure 10A:
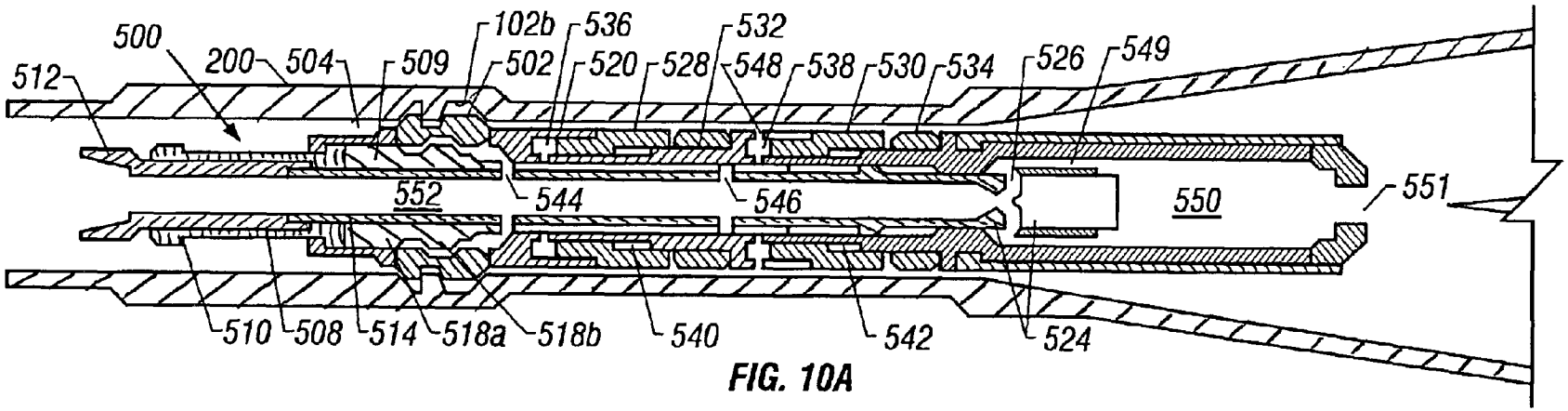
FIGS. 10A–10J illustrate a cementing tool according to another embodiment in different positions.
Figure 10B:
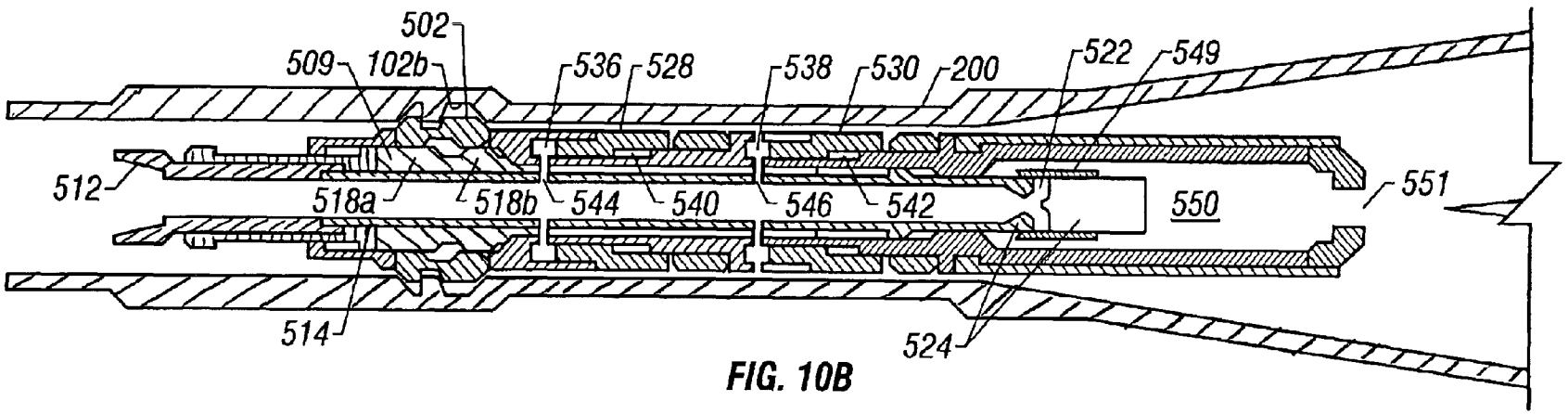

The lower end of the retrieving mandrel 508 is attached to an anchoring mandrel 509, which has enlarged portions 518*a* and 518*b* that protrude outwardly from an outer surface of the anchoring mandrel 509. The outer portions of the enlarged portions 518*a* and 518*b* are adapted to engaged corresponding portions of the locking keys 502 when the anchoring mandrel 509 is pushed downwardly (as shown in FIG. 10B). In the position shown in FIG. 10A, which is the landing position, the enlarged portions 518*a* and 518*b* are disengaged from the locking keys 502.

Figure 11A:
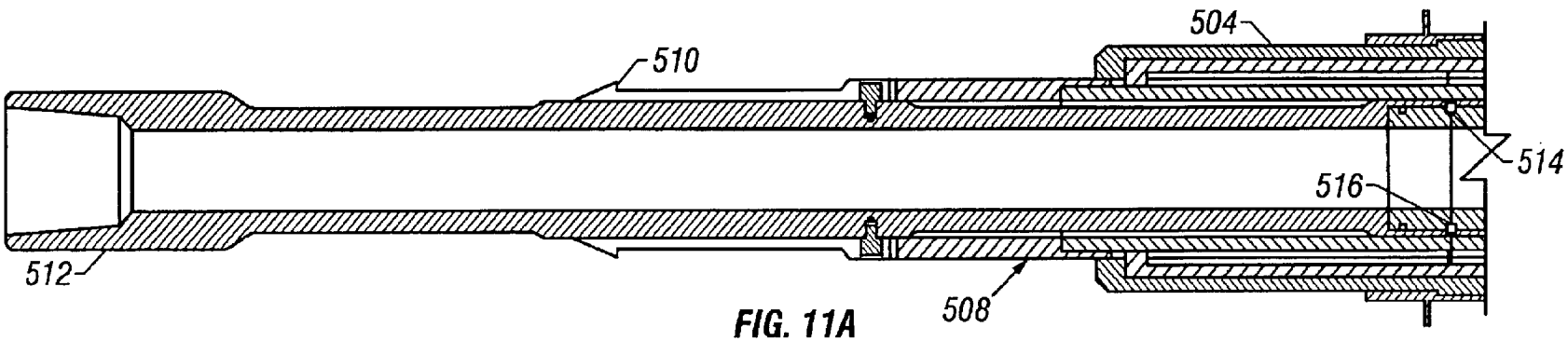
FIGS. 11A–11D are a longitudinal sectional view of the cementing tool of FIGS. 10A–10J.
Figure 11B:
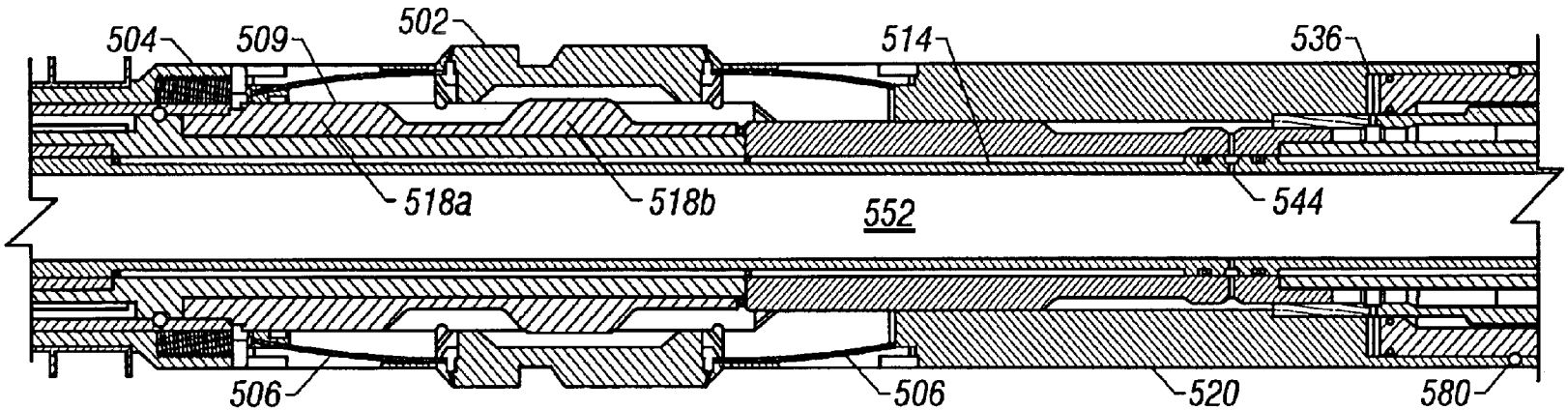
Figure 11C:
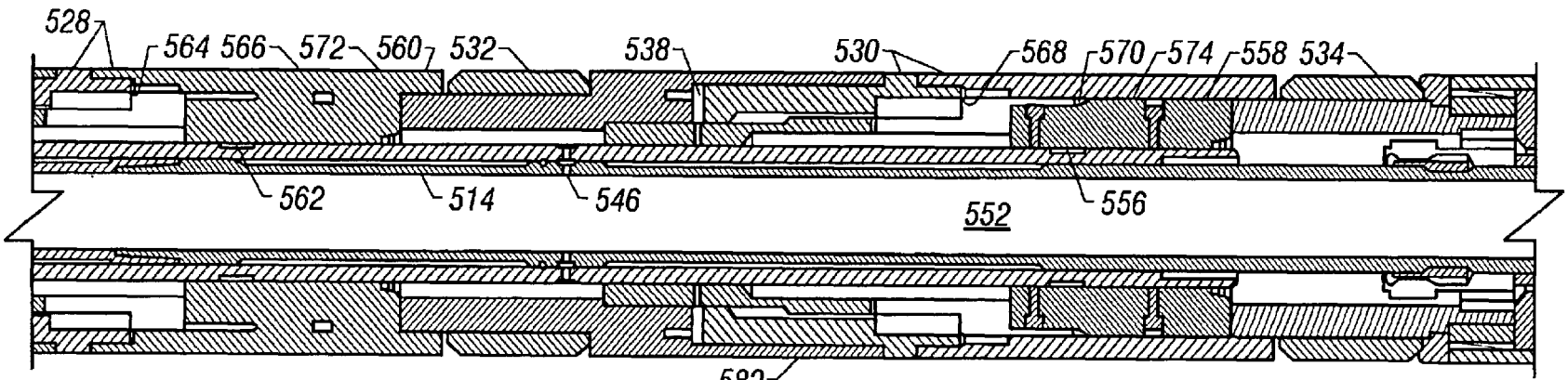
Figure 12D:
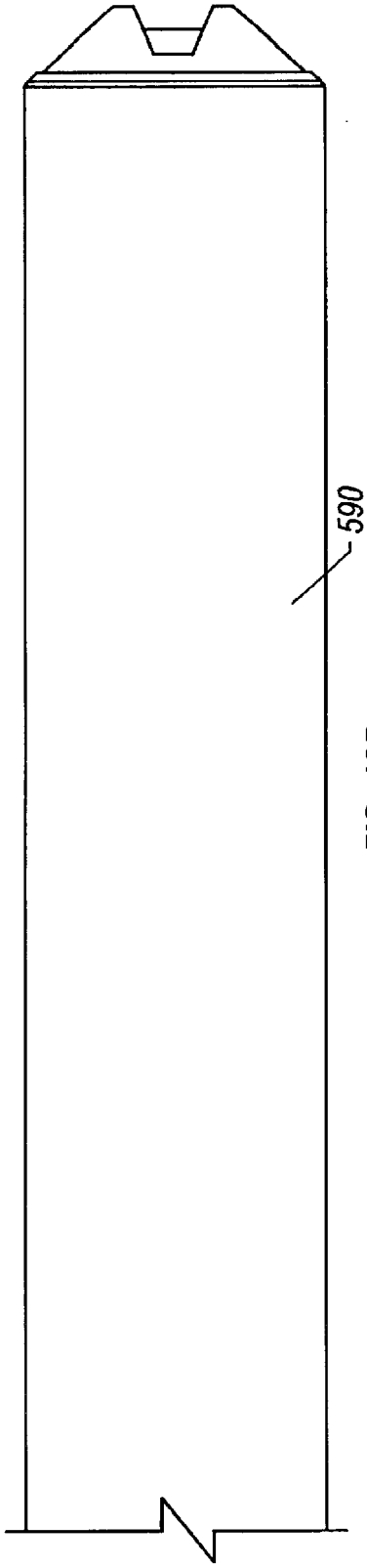

The anchoring mandrel 509 also extends a substantial length of the cementing tool 500. As shown in FIG. 11C, the outer surface of the anchoring mandrel 509 has a pair of grooves 562 and 556 that are adapted to be engaged by stop rings 560 and 558, respectively, when the anchoring mandrel 509 moves downwardly by a predetermined distance. Also, the stop rings 560 and 558 are engaged to unsetting members 572 and 574, respectively, to enable the unsetting of the sealing elements 532 and 534.

Figure 11D:
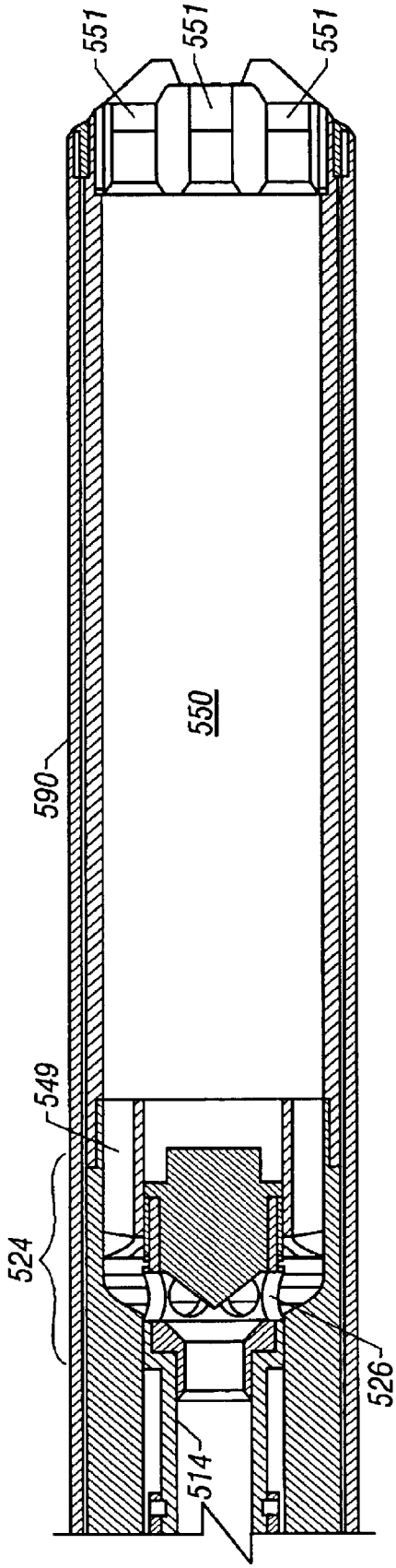

The sleeve 514 defines an inner bore 522 in the cementing tool 500 through which fluid can pass. Examples of such fluid include cement slurry as well as displacement fluid to push the cement slurry during cementing operations. The lower end of the sleeve 514 is attached to a valve member 524 (FIGS. 10A and 11D). The sleeve 514 is movable longitudinally (with movement of the control mandrel 512) in the cementing tool 500 to move the valve member 524 up and down to open or close radial ports 526. In the position of FIG. 10A and 11D, the radial ports 526 are open to enable fluid flow between the inner bore 522 and an annular passageway 549 that leads to a chamber 550 in the cementing tool. Fluid in the chamber 550 flows out of the cementing tool 500 through one or more outlet ports 551 into the casing assembly 200.

The cementing tool 500 includes two sealing elements 532 and 534 (as compared to the one sealing element in the embodiments of FIGS. 3 and 7). The sealing elements 532 and 534 are expandable to engage an inner wall of the casing assembly 200. The sealing elements 532 and 534 are set by a downward force applied by respective setting pistons 528 and 530, which are moveable downwardly by an increased pressure communicated down the work string and through the inner bore 522 of the cementing tool 500. Chambers 536 and 538 are provided above respective setting pistons 528 and 530 that cooperate with reference chambers 540 and 542 (which can be filled with air, for example) to create a differential pressure for moving the setting pistons 528 and 530 downwardly. The setting pistons 528 and 530 are initially attached to the body of the cementing tool 500 by shearing mechanisms 580 (FIG. 11B) and 582 (FIG. 11C), respectively.

Pressure in the bore 522 of the cementing tool 500 is communicated through radial ports 544 of the sleeve 514 and the anchoring mandrel 509 to the chamber 536 when the sleeve 514 and anchoring mandrel 509 are lowered into axial alignment with an inlet of the chamber 536 (as shown in FIG. 10B). Similarly, radial ports 546 formed in the sleeve 514 and the anchoring mandrel 509 communicate fluid pressure from the inner bore 522 of the cementing tool 500 into the chamber 538 when the ports 546 are axially aligned with inlets of the chamber 538. In addition, the chamber 538 has an outlet 548. A nozzle (not shown) is provided at the outlet 548 that provides pressure buildup in the chamber 538 in response to pressure flow through the nozzle.

An outer sleeve 590 is formed around an outer portion of the cementing tool 500 below the sealing element 534. The outer sleeve 590 is formed of a stretchable material, such as rubber or other stretchable material, to facilitate the retrieval of the cementing tool 500 after the cement layer around the cementing tool 500 hardens.

In operation, the cementing tool 500 is attached to a work string, with the cementing tool 500 lowered to a position such that the locking keys 502 are aligned with the landing profiles 102*b* of the casing assembly 200, as shown in FIG. 10A. Next, as shown in FIG. 10B, the cementing tool 500 is actuated to its anchoring position, where the control mandrel 512 is moved downwardly a predetermined distance to push the sleeve 514 and the anchoring mandrel 509 downwardly by the same distance. This causes the enlarged portions 518*a* and 518*b* of the anchoring mandrel 509 to engage the locking keys 502 so that the locking keys are locked against the landing profiles 102*b* of the casing assembly 200. Also, downward movement of the sleeve 514 and the anchoring mandrel 509 causes the radial ports 544 and 546 to be aligned with inlets of the chambers 536 and 538, respectively. The downward movement of the sleeve 514 also causes the valve member 524 to move downwardly, closing the ports 526 to prevent communication of fluid between the inner bore 522 and the annular region 549.

The downward movement of the anchoring mandrel 509 is stopped when a stop ring 558 (biased radially inwardly) engages a groove 556 in the outer surface of the anchoring mandrel 509 (FIG. 11C), and when a stop ring 560 engages a groove 562 in the outer surface of the anchoring mandrel 509. Note that the distance between the initial positions of the groove 556 and stop ring 558 and between the initial positions of the groove 562 and stop ring 560 are the same.

Next, fluid is pumped down the work string and into the inner bore 522 of the cementing tool 500 to communicate fluid to chambers 536 and 538. This causes pressure to build up in the chambers 536 and 538, which in turn causes creation of a differential pressure between the chambers 536 and 540 and between chambers 538 and 542, which shears the shearing mechanisms 580 and 582 and pushes respective setting pistons 528 and 530 downwardly to set the sealing elements 532 and 534, respectively.

Figure 10C:
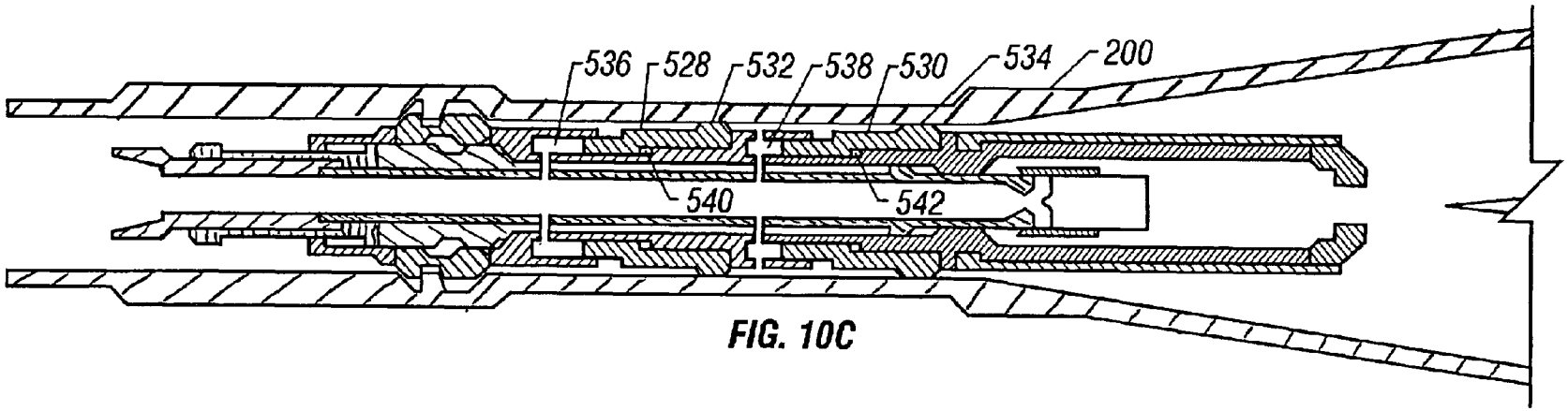

Setting of the sealing elements 532 and 534 are shown in FIG. 10C. Once the sealing elements 532 and 534 are set against the inner wall of the casing assembly 200, the annular region above the sealing element 532 is isolated from the annular region below the lower sealing element 534.

After being set, the sealing elements are tested to ensure that there are no leaks. By using two sealing elements 532, 534, fluid under pressure communicated through the work-string and into the inner bore of the cementing tool 500 is communicated to an annular space outside the cementing tool 500 between the sealing elements 532, 534 (now set as shown in FIG. 10C). The fluid under pressure is communicated through the ports 546, into the chamber 538, and out of the chamber 538 into the annular space between the sealing elements 532, 534. Any leaks around the sealing elements 532, 534 can be detected at the well surface.

Figure 10D:
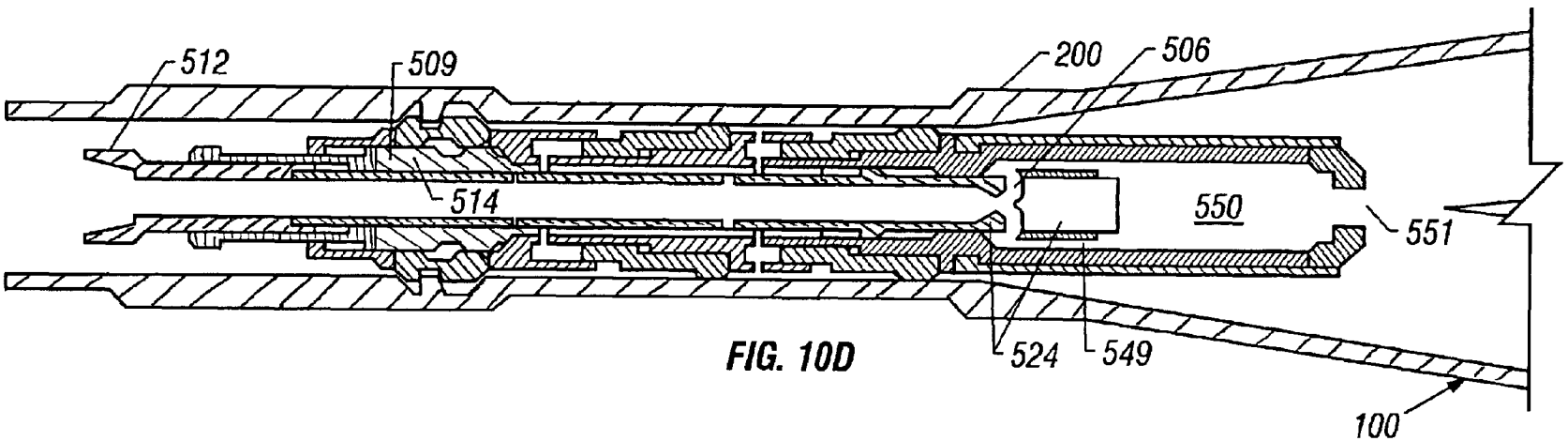

Next, as shown in FIG. 10D, the cementing tool 500 is actuated to its cementing position. This is performed by pulling the control mandrel 512 upwardly. Note that the control mandrel 512 can be moved upwardly without causing a corresponding movement of the anchoring mandrel 509. However, since the control mandrel 512 is connected to the sleeve 514, upward movement of the control mandrel 512 causes a corresponding movement of the sleeve 514 by the same distance. The upward movement of the sleeve 514 causes the valve member 524 to move to its open position so that radial ports 526 are allowed to communicate fluid between the inner bore 522 of the cementing tool 500 and the annular region 549. Thus, cement slurry pumped down the work string and into the inner bore 522 is communicated through the radial ports 526 to the annular region 549 and chamber 550, which in turn is communicated out of the port 551 of the cementing tool 500 into the lateral legs of the casing junction assembly 100.

Figure 10E:
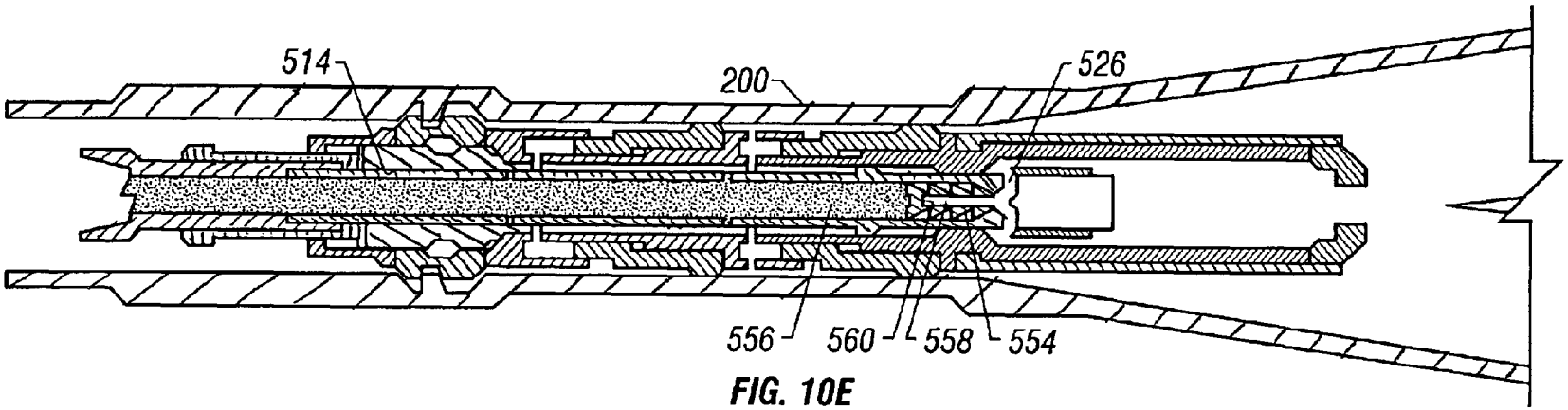
Figure 10F:
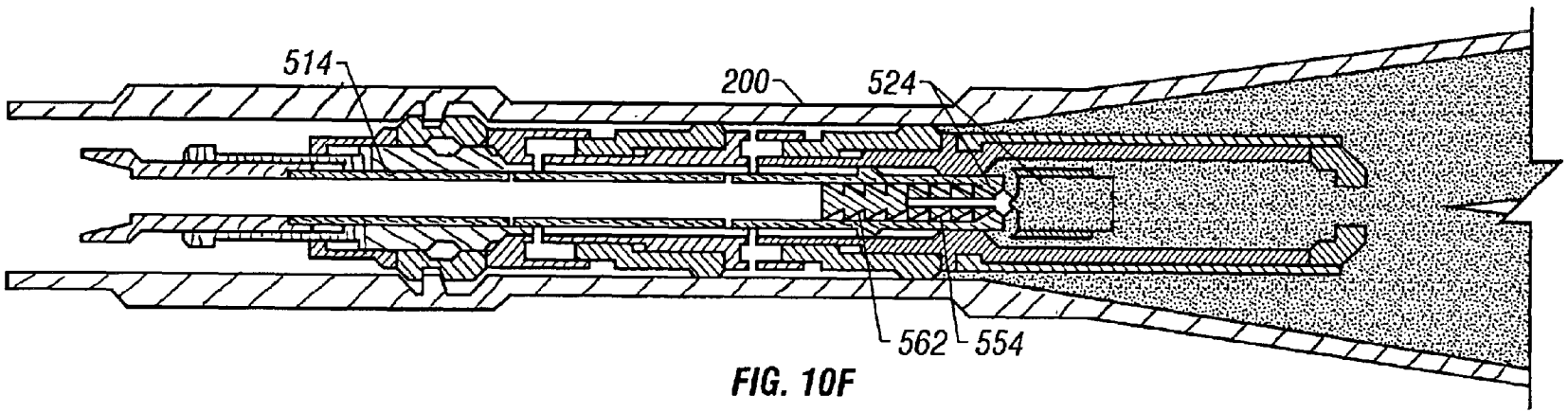

As shown in FIG. 10E, in accordance with one embodiment, a plug 554 (in the form of a dart) is provided ahead of cement slurry 556. The dart 554 has an inner bore 558 through which fluid can communicate. Initially, a rupture disk 560 is provided in the bore 558 of the dart 554. Once the dart 554 lands in a profile provided by the valve member 524, the pressure generated by the cement slurry 556 causes the rupture disk 560 to rupture, thereby allowing the cement slurry to flow through the dart 554 and out through radial ports 526. As shown in FIG. 10F, a second plug 562 is run behind the predetermined volume of the cement slurry, with displacement fluid provided behind the second dart 562. Once the second dart 562 lands on the first dart 554, further movement of the cement slurry is stopped. Although not shown, the cement actually flows to the annular space outside the junction assembly to cement the casing assembly to the wellbore.

Figure 10G:
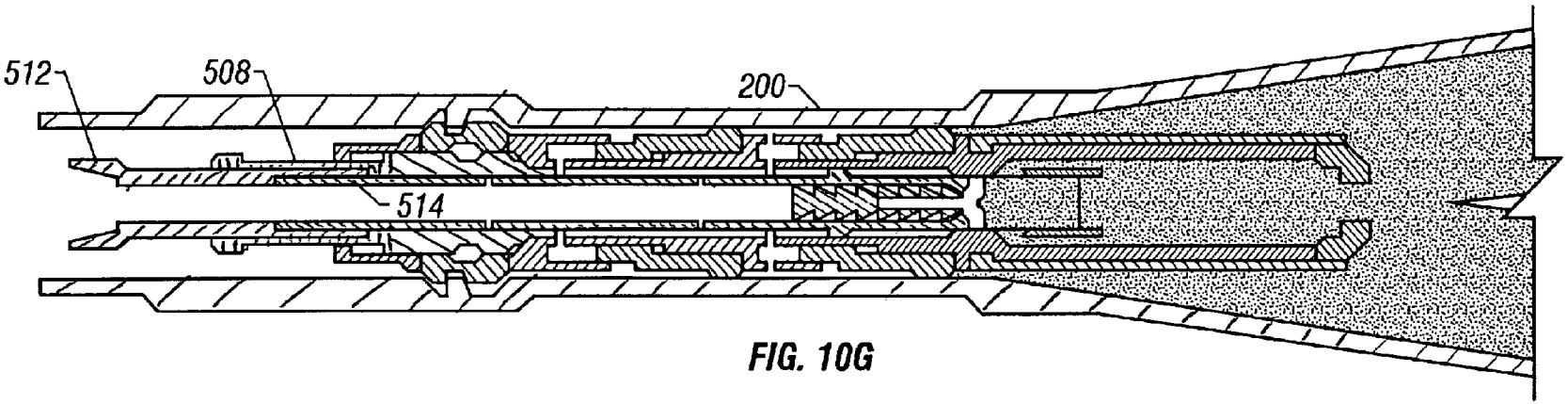
Figure 10H:
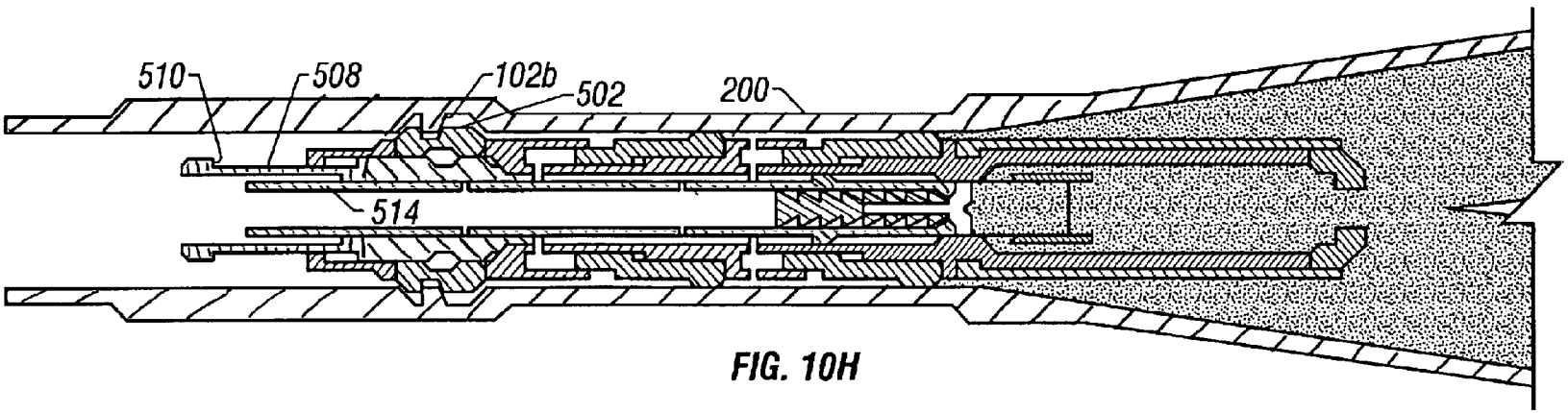
Figure 10I:
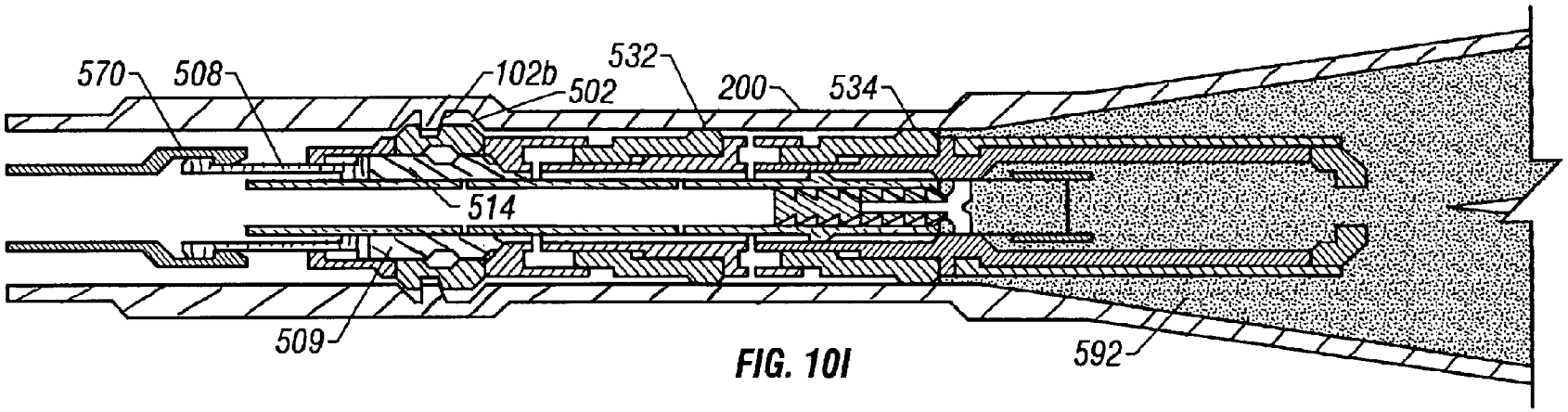
Figure 10J:
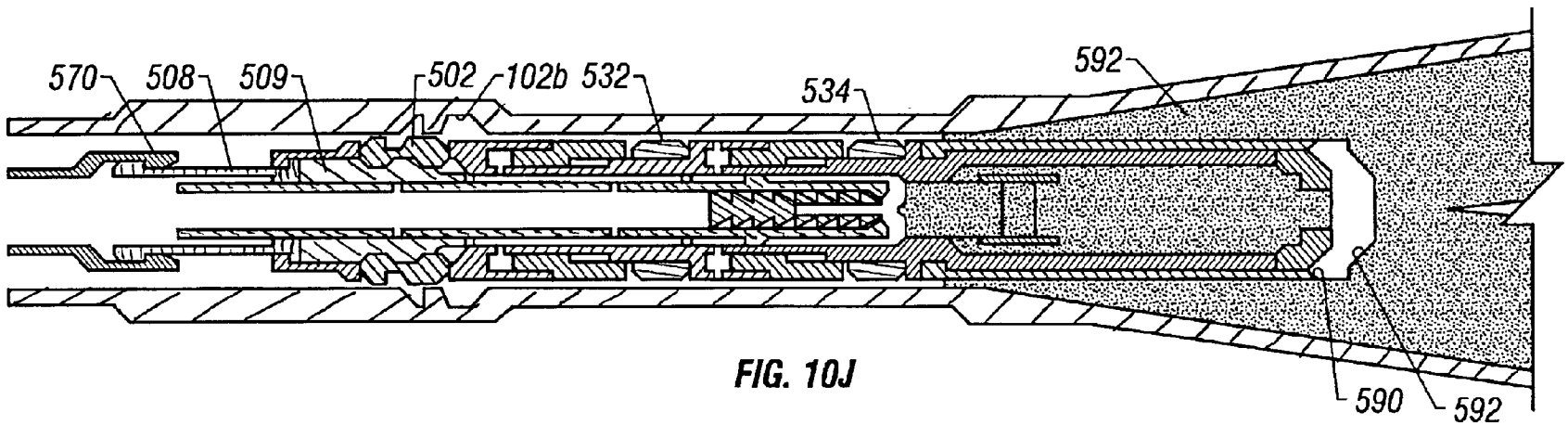
Figure 12A:
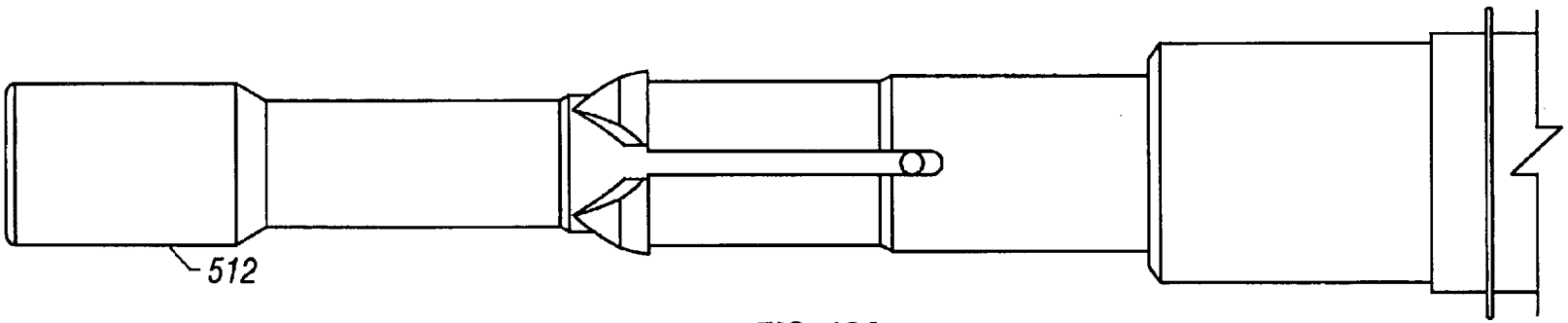
FIGS. 12A–12D are a side view of the cementing tool of FIGS. 11A–11D.
Figure 12B:
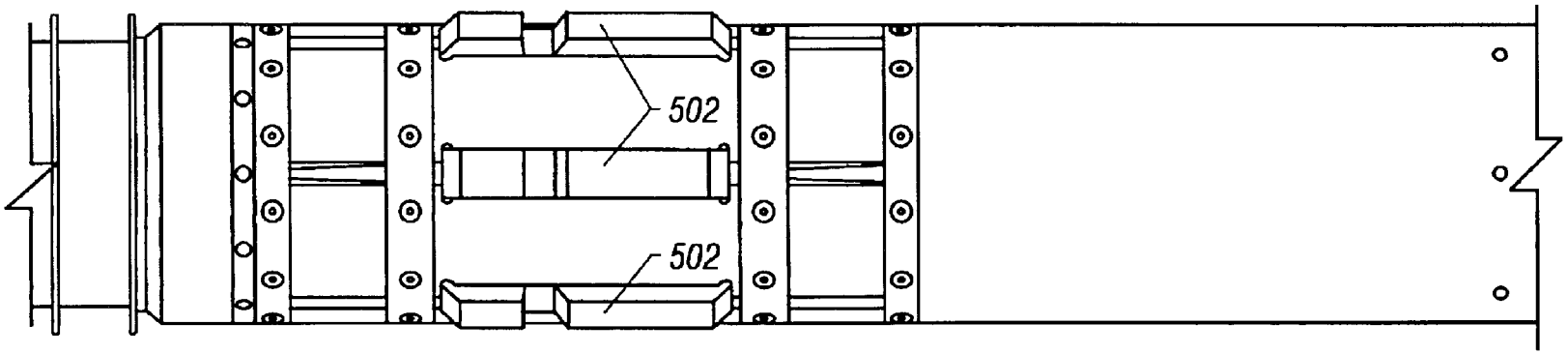
Figure 12C:
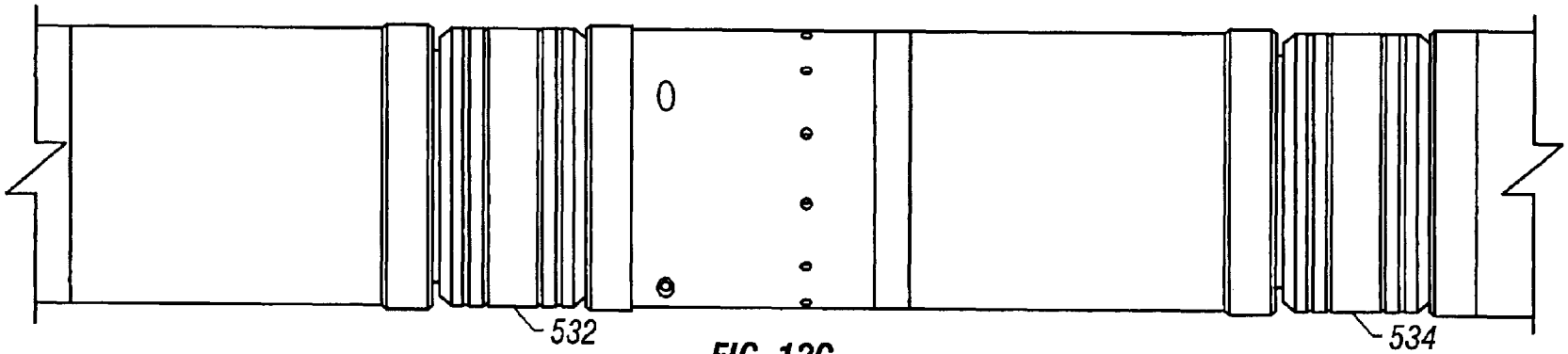

The valve member 524 is then moved upwardly to close the radial ports 526, as shown in FIG. 10G. This is performed by lifting the control mandrel 512 a predetermined distance. By applying a sufficiently large upward force, the shear screws 516 (FIG. 11A) are sheared to allow the control mandrel 512 to be disconnected from the cementing tool 500, as shown in FIG. 10H. Next, a retrieving tool is lowered into the wellbore, with a retrieving element 570 provided at the lower end of the retrieving tool, as shown in FIG. 10I. The retrieving element 570 engages the retrieving profile 510 of the retrieving mandrel 508.

Once the cement has cured after a predetermined time period, a block 592 of cement hardens around the outer surface of a lower portion of the cementing tool 500 below the sealing element 534. The retrieving tool is then lifted to unset the sealing elements 532 and 534. As the retrieving tool is lifted, the retrieving mandrel 508 and anchoring mandrel 509 are moved upwardly so that the anchoring mandrel 509 is disengaged from the locking keys 502. Also note that the stop rings 558 and 560 (FIG. 11C) are engaged in corresponding grooves 556 and 562 of the anchoring mandrel 509 at this time. As a result, upward movement of the anchoring mandrel 509 causes a corresponding upward movement of unsetting members 572 and 574. The unsetting members 572 and 574 have respective shoulders 566 and 570 (FIG. 11C) that are configured to engage protruding portions 564 and 568, respectively, of setting pistons 528 and 530. Thus, upward movement of the unsetting members 572 and 574 causes a corresponding upward movement of the setting pistons 528 and 530. This allows the sealing elements 532 and 534 to unset.

Figure 13A:
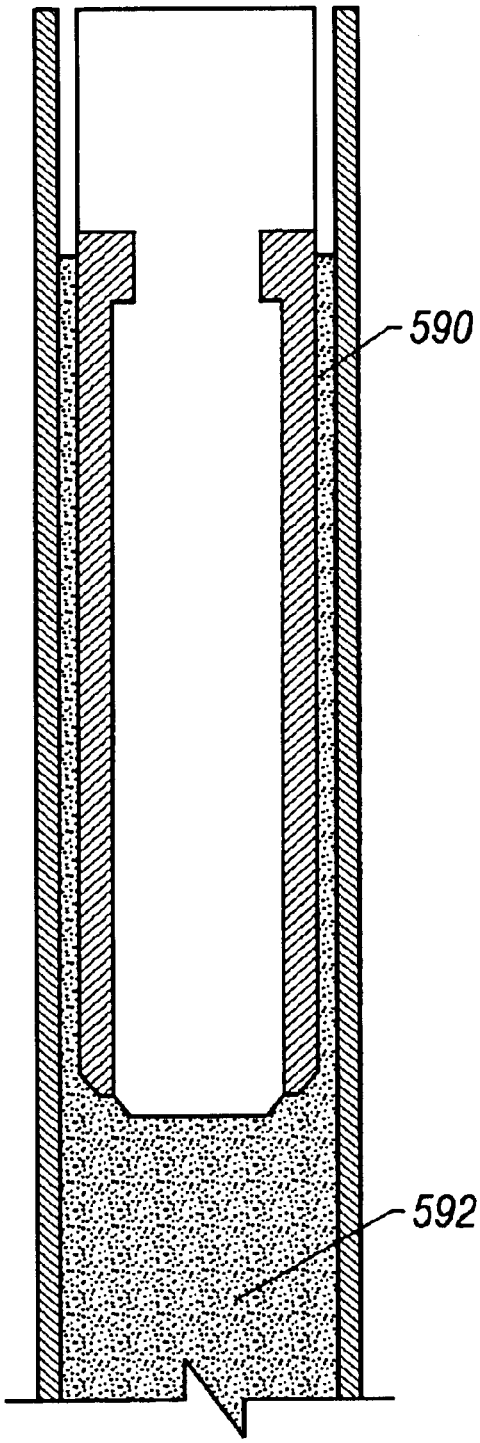
FIGS. 13A–13B illustrate the detachment of the cementing tool from a hardened block of cement.
Figure 13B:
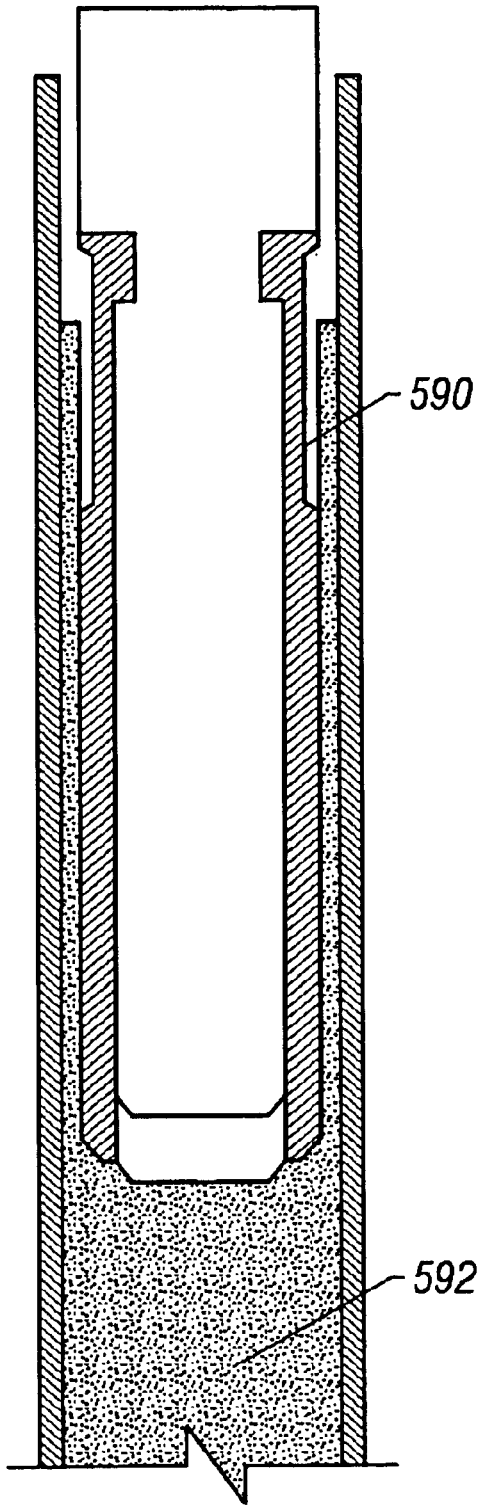

After disengagement of the locking keys 502 and unsetting of the sealing elements 532 and 534, further upward movement causes the cementing tool 500 to be filled. This unlocks the locking keys 502. The outer sleeve 590 is stretched to detach or unbond the sleeve 590 from the cement block 592. This enables easier lifting of the cementing tool 500 out of the cement block 582. The stretching of the sleeve 590 is illustrated in FIGS. 13A–13B.

Some embodiments of the invention may provide one or more of the following advantages over the prior art. A retrievable cementing tool, in some embodiments, can be used to selectively cement around objects or volumes in a casing assembly to avoid the accumulation of cement around the object or in the volume during cementing operations. A casing assembly including a casing junction assembly can be cemented in a wellbore such that clean up at the junction assembly is minimized. A cementing tool is configured to match closely with the internal geometry of a casing junction assembly, which includes one or more bypass devices to convey cement through the internal volume of the junction assembly, thereby preventing cement from filling the junction assembly during the cementing process. Some embodiments of the invention may also be used to reduce the number of downhole trips required for clean up of the junction after cementing operations and to preserve the integrity of the casing junction assembly.

Advantageously, some embodiments of the invention also include an anchoring mechanism, which can be mechanically set and/or released from the surface. This allows for anchoring the cementing tool in the casing during cementing operations and then releasing it from the casing after cementing operations are completed without the need for a subsequent milling operation. Further, because the volume around the anchoring mechanism and body of the cementing tool are protected from cement invasion, the operation of the anchoring mechanism is not altered by the cementing operation and the cementing tool, in whole or in part, can be retrieved from the wellbore. It should be understood that the advantages noted above are merely examples of possible advantages associated with one or more embodiments, and are not intended as limitations on the invention.

While the invention has been described with respect to exemplary embodiments, those skilled in the art will appreciate that numerous modifications and variations can be made therefrom without departing from the spirit of the invention.

What is claimed is:

1. A cementing tool for cementing a casing assembly at a junction of plural wellbores, the casing assembly having a guide shoe with at least one fluid channel, the cementing tool comprising:

a body;

an anchoring mechanism adapted to anchor the body axially within the casing assembly; and a flow conduit extending from the body and adapted to engage the fluid channel of the guide shoe, the flow conduit to channel cement flow through the guide shoe to an annular region outside the casing assembly, wherein the anchoring mechanism is adapted to be released to enable retrieval of the cementing tool from the casing assembly, wherein the guide shoe has at least another fluid channel, the cementing tool further comprising another flow conduit extending from the body and adapted to engage the another fluid channel of the guide shoe.

2. The cementing tool of claim 1, further comprising a sealing element coupled to an external surface of the body and adapted to effect a fluid seal between the body and the casing assembly.

3. The cementing tool of claim 2, further comprising another sealing element coupled to the external surface of the body.

4. The cementing tool of claim 1, further comprising flow control device to control fluid flow through at least one of the flow conduits.

5. The cementing tool of claim 4, wherein the flow control device comprises a sliding sleeve.

6. The cementing tool of claim 4, wherein the flow control device comprises a check valve.

7. The cementing tool of claim 1, wherein the body defines an inner bore and one or more radial ports in communication with the inner bore, the cementing tool further comprising a flow control device adapted to control flow through the one or more radial ports.

8. The cementing tool of claim 7, wherein the inner bore comprises a lower portion below the one or more radial ports to receive a plug provided ahead of a flow of cement.

9. The cementing tool of claim 1, wherein the anchoring mechanism comprises a positive feedback locator to indicate that the cementing tool has reached a target depth.

10. The cementing tool of claim 1, wherein the flow conduits comprise tubes.

11. A cementing tool for cementing a casing assembly at a junction of plural wellbores, comprising:

a body;

an anchoring mechanism adapted to anchor the body axially within the casing assembly;

a flow conduit adapted to channel cement flow to an annular region outside the casing assembly, wherein the anchoring mechanism is adapted to be released to enable retrieval of the cementing tool from the casing assembly;

a sealing element coupled to an external surface of the body and adapted to effect a fluid seal between the body and the casing assembly;

another sealing element coupled to the external surface of the body; and setting members adapted to set the sealing elements.

12. The cementing tool of claim 11, further comprising ports, each port adapted to communicate fluid pressure from inside the cementing tool to one side of a respective setting member.

13. The cementing tool of claim 12, further comprising a shear mechanism adapted to attach the setting members to the body of the cementing tool.

14. A cementing tool for cementing a casing assembly at a junction of plural wellbores, comprising:

a body;

an anchoring mechanism adapted to anchor the body axially within the casing assembly;

a flow conduit adapted to channel cement flow to an annular region outside the casing assembly, wherein the anchoring mechanism is adapted to be released to enable retrieval of the cementing tool from the casing assembly; and a first member slidable from a first position to a second position to lock the anchoring mechanism.

15. The cementing tool of claim 14, wherein the first member is slidable from the second position to the first position to release the anchoring mechanism.

16. The cementing tool of claim 14, further comprising a shear mechanism adapted to temporarily restrain sliding of the first member.

17. A cementing tool for cementing a casing assembly at a junction of plural wellbores, comprising:

a body;

an anchoring mechanism adapted to anchor the body axially within the casing assembly;

a flow conduit adapted to channel cement flow to an annular region outside the casing assembly, wherein the anchoring mechanism is adapted to be released to enable retrieval of the cementing tool from the casing assembly; and a bypass device having a distal end adapted to connect to a guide shoe at an end of the casing assembly, wherein the bypass device has an inner conduit adapted to isolate cement flow from an internal volume of the casing assembly, the inner conduit of the bypass device being part of the flow conduit, wherein the bypass device comprises a plurality of tubes.

18. A cementing tool for cementing a casing assembly at a junction of plural wellbores, comprising:

a body;

an anchoring mechanism adapted to anchor the body axially within the casing assembly; and a flow conduit adapted to channel cement flow to an annular region outside the casing assembly, wherein the anchoring mechanism is adapted to be released to enable retrieval of the cementing tool from the casing assembly; and a bypass device having a distal end adapted to connect to a guide shoe at an end of the casing assembly, wherein the casing assembly defines plural lateral legs, the cementing tool further comprising a barrier disposed about the bypass device to seal cement from entering the internal volume through one of the lateral legs.

19. A cementing tool for cementing a casing assembly at a junction of plural wellbores, the casing assembly having a guide shoe with at least one fluid channel, the cementing tool comprising:

a body;

an anchoring mechanism adapted to anchor the body axially within the casing assembly;

a flow conduit extending from the body and adapted to engage the fluid channel of the guide shoe, the flow conduit to channel cement flow through the guide shoe to an annular region outside the casing assembly, wherein the anchoring mechanism is adapted to be released to enable retrieval of the cementing tool from the casing assembly; and an outer sleeve formed of a stretchable material, the outer sleeve adapted to detach from hardened cement outside the cementing tool to enable easy removal of the cementing tool from the hardened cement.

20. A cementing tool for cementing a casing assembly at a junction of plural wellbores, the casing assembly having a guide shoe with at least one fluid channel, the cementing tool comprising:

a body;

an anchoring mechanism adapted to anchor the body axially within the casing assembly; and a flow conduit extending from the body and adapted to engage the fluid channel of the guide shoe, the flow conduit to channel cement flow through the guide shoe to an annular region outside the casing assembly, wherein the anchoring mechanism is adapted to be released to enable retrieval of the cementing tool from the casing assembly, wherein the casing assembly has a wall separating the plural wellbores, and wherein the body of the cementing tool is adapted to equalize pressure across the wall.

21. A method of cementing a casing assembly at a junction of plural wellbores, comprising:

lowering a cementing tool to engage inside the casing assembly;

providing a plug ahead of cement slurry into the cementing tool, the plug having a rupture element;

rupturing the rupture element in the plug to enable the cement slurry to flow through the plug;

pumping the cement slurry through the cementing tool to fill an annular region outside the casing assembly;

disengaging the cementing tool from the casing assembly; and lifting the cementing tool from the casing assembly, wherein lifting the cementing tool is accomplished without first milling at the junction.

22. The method of claim 21, further comprising providing a landing mechanism on the cementing tool to engage a profile inside the casing assembly.

23. The method of claim 22, further comprising setting at least one sealing element to seal the cementing tool against the casing assembly.

24. The method of claim 23, wherein disengaging the cementing tool comprises unlocking the landing mechanism and unsetting the sealing element.

25. The method of claim 21, further comprising providing a positive feedback indicator on the cementing tool to indicate when the cementing tool is engaged in the casing assembly.

26. The method of claim 21, further comprising providing a flow control device in the cementing tool to control the flow of a cement slurry.

27. The method of claim 26, wherein providing the flow control device comprises providing one of a check valve and a sleeve valve.

28. The method of claim 26, further comprising closing the flow control device to set a sealing element of the cementing tool against an inner surface of the casing assembly.

29. The method of claim 28, further comprising opening the flow control device after setting the sealing element, wherein pumping the cement slurry through the cementing tool comprises pumping the cement slurry through the flow control device.

30. A method of cementing a casing assembly at a junction of plural wellbores, comprising:

lowering a cementing tool to engage inside the casing assembly;

pumping cement slurry through the cementing tool to fill an annular region outside the casing assembly;

disengaging the cementing tool from the casing assembly;

lifting the cementing tool from the casing assembly; and providing a sleeve formed of a stretchable material around an outer surface of the cementing tool; and detaching the cementing tool from a hardened block of cement by stretching the sleeve to unbond from the hardened block of cement.

31. A system comprising:

a casing assembly having a junction assembly to complete a junction of plural wellbores, the junction assembly having plural branch legs; and a cementing tool adapted to be releasably engaged in the casing assembly to direct flow of cement into the junction assembly and out into an annular region around the casing assembly, wherein the cementing tool has an external seal and a member adapted to set the external seal against an inner wall of the casing assembly.

32. The system of claim 31, wherein the cementing tool has an anchoring mechanism, and the casing assembly has a landing profile, the anchoring mechanism adapted to engage the landing profile.

33. A system comprising:

a casing assembly having a guide shoe with at least one fluid channel; and a cementing tool for cementing the casing assembly, the cementing tool comprising:

a body;

an anchoring mechanism adapted to anchor the body within the casing assembly; and a flow conduit extending from the body to engage the fluid channel of the guide shoe, wherein the casing assembly has a junction assembly having plural legs.

34. The system of claim 33, wherein the anchoring mechanism is adapted to be released to enable retrieval of the cementing tool from the casing assembly.

35. The system of claim 33, further comprising a plug provided in the cementing tool ahead of cement slurry, the plug adapted to be ruptured to enable flow of cement slurry through the flow conduit.

36. The system of claim 33, wherein the flow conduit comprises a tube.

37. A system comprising:

a casing assembly having a guide shoe with at least one fluid channel; and a cementing tool for cementing the casing assembly, the cementing tool comprising:

a body;

an anchoring mechanism adapted to anchor the body within the casing assembly; and a flow conduit extending from the body to engage the fluid channel of the guide shoe, wherein the guide shoe comprises at least another flow channel, and the cementing tool comprises at least another flow conduit extending from the body and adapted to engage the at least another flow channel.

38. The system of claim 37, wherein the flow conduits are tubes.

* * * * *